US006229902B1

(12) United States Patent
Proni

(10) Patent No.: US 6,229,902 B1
(45) Date of Patent: May 8, 2001

(54) LOUDSPEAKER WITH FRAME COOLING STRUCTURE

(76) Inventor: Lucio Proni, 2571 Mayfair La., Weston, FL (US) 33327

( * ) Notice: Subject to any disclaimer, the term of this patent is extended or adjusted under 35 U.S.C. 154(b) by 0 days.

(21) Appl. No.: 09/437,053

(22) Filed: Nov. 9, 1999

(51) Int. Cl.[7] ..... H04R 25/01

(52) U.S. Cl. ..... 381/400; 381/396

(58) Field of Search ..... 381/386, 396, 381/397, 398, 400, 403, 420, 433, FOR 151, FOR 152, FOR 165, FOR 159

(56) References Cited

U.S. PATENT DOCUMENTS

| | | | | |
|---|---|---|---|---|
| 2,429,470 | | 10/1947 | Knbowles | 179/115.5 |
| 3,991,286 | | 11/1976 | Henricksen | 179/115.5 |
| 4,327,257 | | 4/1982 | Schwartz | 179/115.5 |
| 4,547,632 | | 10/1985 | Bryson | 179/115.5 |
| 4,590,332 | * | 5/1986 | Delbuck | 381/397 |
| 4,821,331 | | 4/1989 | Murayama et al. | 381/192 |
| 4,933,975 | | 6/1990 | Button | 381/192 |
| 5,042,072 | | 8/1991 | Button | 381/192 |
| 5,081,684 | | 1/1992 | House | 381/199 |
| 5,303,209 | | 4/1994 | Frasl | 367/174 |
| 5,357,586 | | 10/1994 | Nordschow | 381/199 |
| 5,497,428 | | 3/1996 | Rojas | 381/199 |
| 5,625,701 | | 4/1997 | Scanlon | 381/197 |

FOREIGN PATENT DOCUMENTS

| | | |
|---|---|---|
| 2667212 | 3/1992 | (FR) . |
| 3-220897 | 9/1991 | (JP) . |

* cited by examiner

*Primary Examiner*—Stella Woo
*Assistant Examiner*—P. Dabney
(74) *Attorney, Agent, or Firm*—Holland & Knight LLP

(57) ABSTRACT

A loudspeaker comprises a frame mounted to a motor structure, an upper suspension connected between the voice coil of the motor structure and the frame, and, a lower suspension extending from the voice coil to the frame in position to form a cavity between the top plate of the motor and the lower suspension. The frame includes a bottom plate having a number of spaced vanes which rest atop the top plate of the motor and form passages therebetween through which a comparatively high volume of air is circulated at relatively high velocity in and out of the cavity between the lower suspension and lower end of the frame in response to excursion of the voice coil during operation of the speaker. The passages are positioned to direct such air flow over the top plate, and in some embodiments along at least a portion of the voice coil, to aid in cooling of these elements.

46 Claims, 24 Drawing Sheets

LOUDSPEAKER WITH FRAME COOLING STRUCTURE

FIELD OF THE INVENTION

This invention relates to loudspeakers, and, more particularly, to structure associated with the frame and top plate of a loudspeaker which is effective to direct a flow of cooling air in the area of the top plate and at least a portion of the voice coil of the loudspeaker.

BACKGROUND OF THE INVENTION

Loudspeakers generally comprise a frame, motor structure, a diaphragm, a lower suspension or spider and a surround. In one common type of speaker, the motor structure includes a top plate spaced from a back plate with a permanent magnet mounted therebetween. The magnet and top plate define an air gap within which a hollow, cylindrical-shaped voice coil is axially movable with respect to a fixed pole piece which is centrally mounted atop the back plate.

The voice coil generally comprises a cylindrical former which receives a winding of wire. The diaphragm extends between the voice coil and the surround, which, in turn, is mounted to the upper end of the frame. The spider is connected at one end to the voice coil, and at its opposite end to a point between the upper and lower ends of the frame. In this construction, one cavity or space is formed in the area between the diaphragm and spider, and a second cavity is formed in the area between the spider and the top plate of the motor structure. Many speaker designs include a dust cap mounted to the diaphragm in position to overlie and cover the voice coil and pole piece.

In the course of operation of a speaker of the type described above, electrical energy is supplied to the voice coil causing it to axially move relative to the pole piece and within the air gap formed by the top plate and magnet. The diaphragm, spider and the surround, move with the excursion of the voice coil. A pervasive problem associated with speaker operation involves the build up of heat produced by the voice coil and radiated to surrounding surfaces. Both the voice coil and top plate become quite hot during speaker operation which can reduce the power handling of the speaker, and increase power compression, i.e. a reduction in acoustic output due to temperature-related voice coil resistance.

A variety of designs have been employed in the prior art to address the problems associated with heat build up in speakers. Much of the design effort has been devoted to creating a flow of cooling air over the voice coil itself, such as disclosed, for example, in U.S. Pat. No. 5,042,072 to Button; U.S. Pat. No. 5,081,684 to House; and U.S. Pat. No. 5,357,586 to Nordschow et al. A typical construction in speaker designs of this type involves the formation of passages in or along the voice coil which form a flow path for the transfer of cooling air from the cavity between the voice coil and the dust cap and/or diaphragm, and vent openings usually formed in the back plate of the motor structure. An air flow through these passages is created in response to movement of the diaphragm with the excursion of the voice coil. When the diaphragm moves in one direction, air is drawn from outside of the speaker, through the vent opening in the back plate, along the passages in or along the voice coil and then into the cavity. Movement of the diaphragm in the opposite direction creates a flow out of the cavity along the reverse flow path.

One problem with the approach described above is that the design and construction of the flow passages often do little more than provide venting of the area or cavity between the diaphragm and voice coil. The actual air flow generated by movement of the diaphragm is typically relatively low volume. As a result, very little cooler ambient air from outside of the speaker actually flows along the voice coil to provide effective cooling. Additionally, little or no air flow is directed along the top plate, which remains hot.

Alternative designs depend upon thermal conduction and convection to cool the voice coil and/or top plate. Typically, structure associated with the frame is positioned in engagement with the top plate and proximate the voice coil of the motor to provide a heat sink or thermally conductive path along which heat can move from the relatively hot voice coil and top plate to the relatively cool frame. In U.S. Pat. No. 4,933,975 to Button, for example, a collar is positioned at the inside diameter of the frame near the voice coil, a base plate is connected to the collar and rests atop the top plate of the motor, and, a number of fins extend radially outwardly from the collar along the base plate to the outer portion of the frame. Collectively, these elements form a heat sink for the conduction of heat away from the voice coil and top plate, outwardly to the frame.

Constructions of the type described above provide some benefit, but reliance on conduction and convection alone to remove heat from the top plate and voice coil is of limited effectiveness with today's high performance, high excursion speakers. This is particularly true in applications such as vehicle speakers where space is at a premium and the speaker frame must be as compact and light weight as possible. In such designs, it is often not feasible to incorporate additional frame structure whose purpose is primarily or exclusively intended for the conduction of heat away from the voice coil and top plate.

At least one attempt has been made in the prior art to provide structure for the removal of heat from the voice coil using both conduction of heat into elements of the speaker frame, and the circulation of air past such elements. As disclosed in French Patent No. 2,667,212, a ring-shaped component is located between the bottom of the frame and the top plate of the motor which comprises a circular collar circumferentially disposed about the voice coil, and a number of vanes extending radially outwardly from the collar. The vanes are spaced from one another to define passages which are open at the outer edge of the frame, and open within the cavity formed between the spider or lower suspension of the speaker and the top plate of the motor.

The stated objective of the design disclosed in the French patent is to conduct heat away from the voice coil though the collar and vanes, and then create a flow of air over these surfaces resulting from the pumping action of the spider as it moves with the excursion of the voice coil during speaker operation. The problem with this approach is that the flow of air developed by the movement of the spider is essentially ineffective to transfer heat away from the frame and the vanes. Because the passages between adjacent vanes are open at their opposite ends, and open or exposed along their entire surface area within the cavity, any movement of air located in the area between the spider and top plate of the motor is at comparatively low velocity, and, hence, low volume. Little or no pressurization of the air is present within the relatively large volume cavity with the vanes completely exposed, and therefore little or no velocity is obtained in the air flow created by movement of the spider. As a result, limited heat transfer occurs between the low velocity, low volume flow of air past the vanes and collar, and the cooling effect of the "pumping" action of the spider is minimal.

SUMMARY OF THE INVENTION

It is therefore among the objectives of this invention to provide a loudspeaker construction which provides a comparatively high velocity, high volume flow of cooling air in the area of the voice coil and top plate of the motor structure, which increases power handling of the speaker, which reduces power compression and which is efficient and economical to manufacture.

These objectives are accomplished in a loudspeaker including a frame mounted to a motor structure, a diaphragm connected between the voice coil of the motor structure and a surround carried by the frame, and, a spider extending from the voice coil to the frame in position to form a cavity between the top plate of the motor and the spider. The frame includes a bottom plate having a number of spaced vanes which rest atop the top plate of the motor and define passages therebetween through which a comparatively high volume of air is circulated at relatively high velocity in and out of the cavity between the spider and bottom plate in response to excursion of the voice coil during operation of the speaker. The passages are positioned to direct such air flow over the top plate, and in some embodiments along at least along a portion of the voice coil, to aid in cooling of these elements.

This invention is predicated upon the concept of reducing the temperature of the voice coil and the top plate of the motor during operation of a loudspeaker by employing different combinations of heat transfer techniques, all of which are dependent upon both conduction of heat within metallic elements of the speaker and the passage of a comparatively high volume flow of air over or at least proximate to such elements. The high volume air flow is achieved by creating flow passages between a number of spaced vanes located in a confined area between the top plate of the motor and a bottom plate of the frame. The outer end of each flow passage is open to the ambient air, but, unlike the French patent noted above, the top of such passages is closed by the bottom plate of the frame. In response to movement of the diaphragm and spider with the excursion of the voice coil, air flowing through such passages enters and exits the cavity between the spider and bottom plate of the frame through comparatively small apertures formed in the bottom plate near the inner end of the passages, and/or through a small space created between the inner edge of the bottom plate and the voice coil. By reducing the cross sectional area within which the cooling air can flow, its velocity is increased, and, in turn, the volume of air moving through the passages is increased. In alternative embodiments of this invention, heat transfer occurs between the voice coil and the adjacent metallic elements of the frame, between the high volume air flow and such metallic elements, and, in some embodiments, directly between the high volume air flow and the voice coil.

In one presently preferred group of embodiments, a number of circumferentially spaced vanes extend from the inner edge of the bottom plate of the frame toward its outer edge. Apertures or openings are formed at the inner edge of the bottom plate, either by protruding ends of the vanes or in the bottom plate itself. Excursion of the diaphragm and spider creates a flow of air through the passages between adjacent vanes, and in and out of the cavity, along the top plate of the motor, directly against the voice coil and then along the inner edge of the bottom plate between the voice coil and inner ends of the vanes. Heat transfer takes place due to conduction from the voice coil and top plate into the metallic bottom plate and vanes, as well as a result of the passage of the high volume flow of air over the top plate, vanes, voice coil and bottom plate.

In an alternative group of embodiments of this invention, essentially the same construction described above is employed except an inner ring is mounted to the inner edge of the bottom plate which extends to the top plate and closes off each passage in the area of the voice coil. The flow of air through the passages is directed into and out of the cavity via apertures formed in the bottom plate of the frame near the inner ring. In these embodiments, the inner ring conducts heat from the voice coil and transfers it to the vanes and bottom portion of the frame. The high volume air flow in and out of the cavity removes heat from the inner ring, as well as from the top plate and vanes, in the course of moving through the passages.

A still further embodiment of this invention includes cooling structure which develops essentially two flow paths for the air entering and leaving the cavity. Circumferentially spaced vanes extend between the bottom plate and top plate, and are open at either end so that a portion of the air flowing therethrough is transmitted directly against the voice coil. Additionally, apertures are formed in the bottom plate at a location spaced from its inner edge. Another portion of the air flowing through the passages is directed through these apertures in the course of entering and exiting the cavity, which removes heat from the inner portion of the bottom plate which it has conducted directly from the voice coil.

In each of the above-described embodiments, the cooling structure of this invention, including the vanes, inner ring and mounting plate, are integrally formed on the bottom plate of the frame. Still further alternative embodiments are provided in which the bottom plate of the frame is planar, and the cooling structure is formed as part of an "attachment" or separate element connected between the bottom plate and the top plate of the motor. The speakers of this invention which include an attachment exhibit the same thermal transfer characteristics as the embodiments described above.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
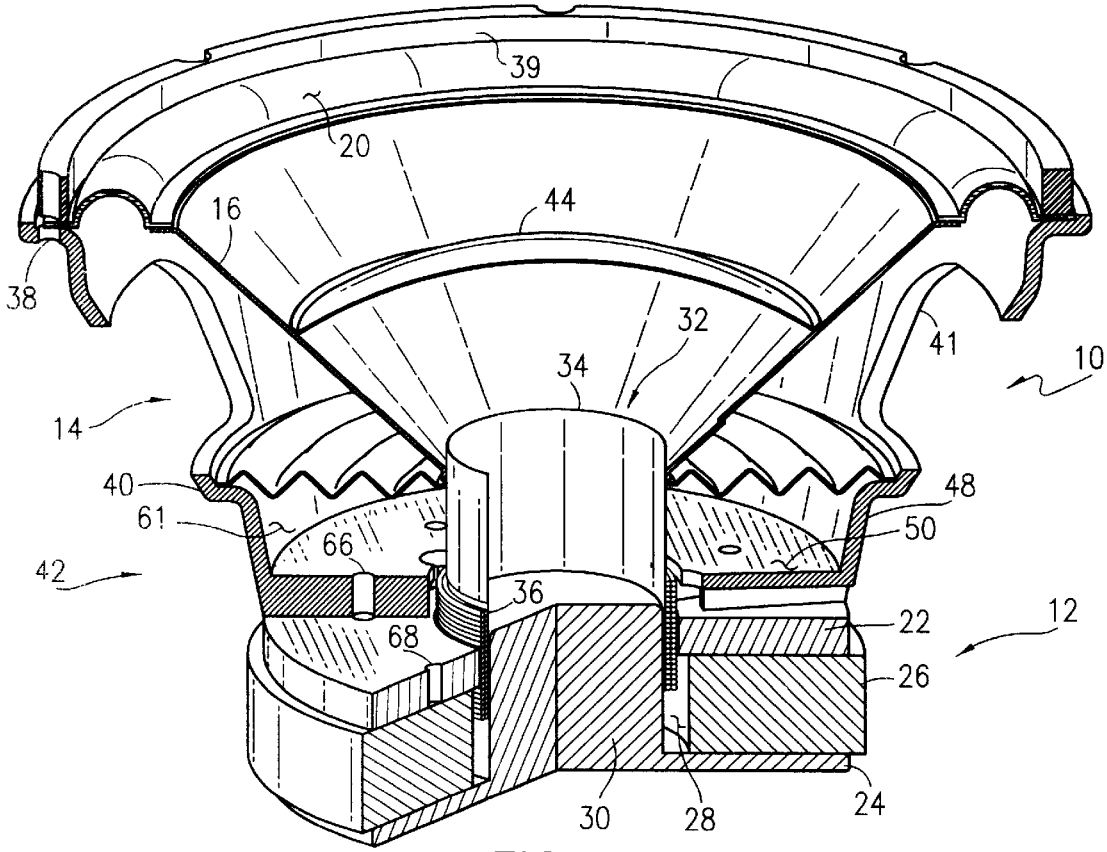
FIG. 1 is cross sectional, perspective view of a loudspeaker employing one embodiment of the cooling structure of this invention.

Referring now to the drawings, a number of embodiments of a loudspeaker 10 are illustrated in FIGS. 1–16 which differ from one another by the particular structure employed to provide cooling of certain elements during operation of the speaker 10. For purposes of the present discussion, the overall configuration of the speaker 10 depicted in FIG. 1 is described in detail, it being understood that the other speakers 10 have the same construction except as noted specifically below.

The speaker 10 generally comprises a motor structure 12, a frame 14, a diaphragm 16, a lower suspension or spider 18 and a surround 20. Conventionally, the motor structure 12 includes a top plate 22 and a back plate 24 which are spaced from one another. A permanent magnet 26 is mounted between plates 22 and 24. The central bore 28 of the magnet 26 and the top plate 22 form an air gap within which a pole piece 30 is mounted atop the back plate 24. A voice coil 32 is concentrically disposed about the pole piece 30, and axially movable relative thereto during operation of the speaker 10. Preferably, the voice coil 32 includes a hollow, cylindrical-shaped former 34, whose exterior surface receives a wire winding 36.

The voice coil 32 is held in place with respect to the pole piece 30 by the diaphragm 16, spider 18 and surround 20. One end of the diaphragm 16 is affixed to the former 34 by adhesive or the like, and its opposite end connects to the surround 20. The surround 20, in turn, is adhesively mounted to a seat 38 formed at the upper end of frame 14 and partially covered by a speaker gasket 39 as shown in FIG. 1. The diaphragm 16 and surround 20 collectively form an upper suspension to support the voice coil 32. Similarly, the lower suspension or spider 18 mounts to the former 34 in the same location as the diaphragm 16, and the opposite end of spider 18 is mounted to a shoulder 40 formed in the lower end 42 of frame 14. A dust cap 44 is mounted near the lower end of the diaphragm 16 immediately above the former 34 which, when connected to the diaphragm 16 and spider 18 as shown, is concentrically disposed about the pole piece 30. For purposes of the present discussion, the terms "upper" or "upwardly" refer to the vertically upward direction in the orientation of the speaker 10 depicted in FIG. 1. The terms "lower" or "downwardly" refer to the opposite direction. The terms "inner" or "inwardly" refer to a location in the area of the voice coil 32, whereas "outer" or "outwardly" refer to the opposite direction.

Figure 2:
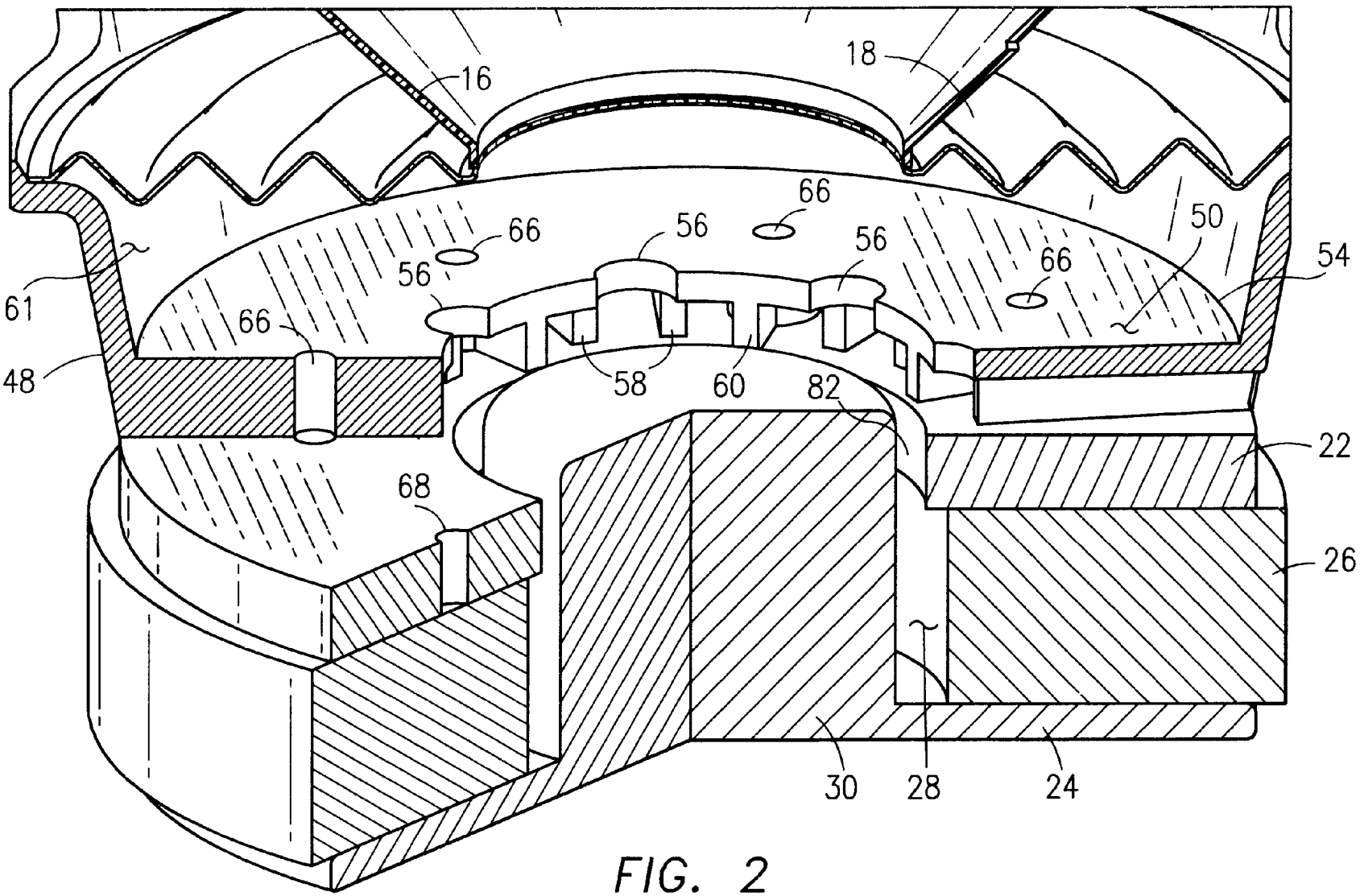
FIG. 2 is a view similar to FIG. 1 except with the voice coil removed.
Figure 3:
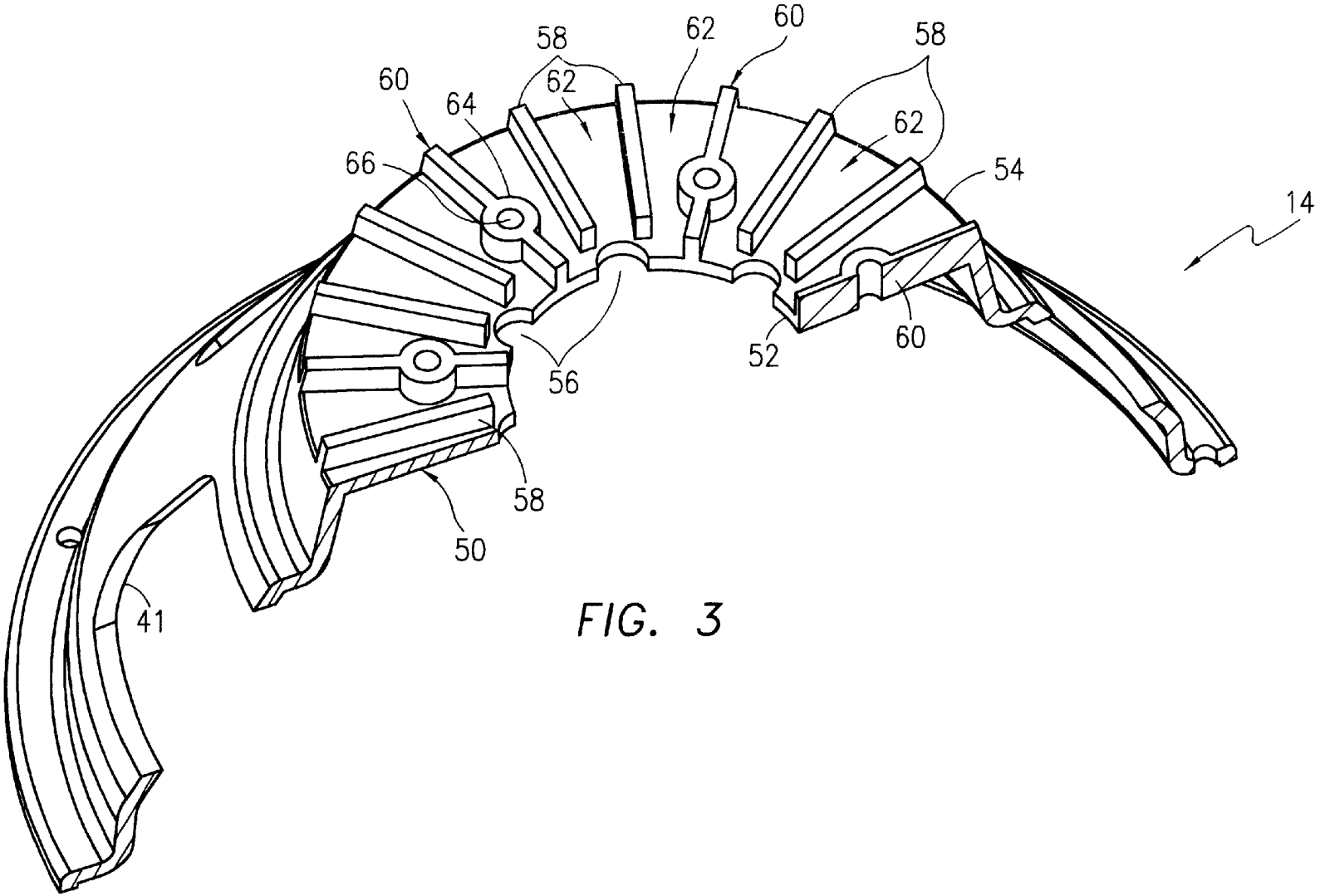
FIG. 3 is bottom perspective view of a portion of the frame in the speaker depicted in FIG. 2.

Referring to FIGS. 1–3, in this embodiment of speaker 10 the upper portion of the frame 14 is formed with a number of spaced openings or windows 41. The lower end 42 of frame 14 is formed with an angled wall 48 beneath the shoulder 40 which, in turn, extends to an annular or ring-shaped bottom plate 50 which forms the base of the frame 14. The bottom plate 50 has an inner edge 52 located proximate the voice coil 32, and an outer edge 54 where it connects to the angled wall 48 of frame 14. The bottom plate 50 is formed with a number of circumferentially-spaced, generally semi-circular cut-outs or openings 56 which extend from its inner edge 52 toward the outer edge 54. A number of vanes 58 and 60 are mounted or integrally formed on the bottom plate 50 which are spaced from one another to define passages 62 therebetween. As best seen in FIG. 3, the vanes 58 extend from the openings 56 to the outer edge 54 of bottom plate 50, whereas the vanes 60 are located in between the openings 56 and extend from the inner edge 52 to the outer edge 54 of bottom plate 50. Preferably, each vane 60 is formed with a mounting ring 64 having a throughbore 66 which receives a screw (not shown) or other fastener. The screw extends into an aligning bore 68 formed in the top plate 22 to secure the frame 14 thereto.

In the course of normal operation of the speaker 10, the voice coil 32 is moved vertically upwardly and downwardly with respect to the pole piece 30. Because the diaphragm 16 and spider 18 are mounted to the voice coil 32, these elements also move vertically during speaker operation. The purpose of the vanes 58 and 60, and the passages 62 formed therebetween, is to take advantage of the natural "pumping" action of the diaphragm 16, and to a lesser extent the lower suspension or spider 18. When the diaphragm 16 and spider 18 are moved vertically upwardly in response to excursion of the voice coil 32, ambient air from outside the speaker 10 is drawn through the passages 62 and openings 56 into a cavity 61 formed between the spider 18, and the bottom plate 50 at the lower end 42 of frame 14. Conversely, in the course of movement of the diaphragm 16 and spider 18 vertically downwardly with the voice coil 32, air within the cavity 61 is forced outwardly in the reverse direction along the same flow path.

The overall objective of the cooling structure of this embodiment, and the others described below, is to transfer heat away from the voice coil 32 and the top plate 22, which become two of the hottest areas during operation of the speaker 10. The inner edge 52 of bottom plate 50 is concentrically disposed about the voice coil 32 and proximate thereto so that at least some heat is conducted away from the voice coil 32 by the bottom plate 50, and the vanes 58 and 60. Additionally, each of the passages 62 is open at both ends causing comparatively cool air drawn from outside of the speaker 10 to flow directly against the voice coil 32, and then along at least a portion of the length of the voice coil 32 in the course of moving through the openings 56 in the bottom plate 50 into and out of the cavity 61. The flow of air within the passages 62 and openings 56 therefore transfers heat from the surfaces which have conducted heat from the voice coil 32, i.e. the bottom plate 50 and vanes 58, 60, it transfers heat from the top plate 22 and such air flow transfers heat from the voice coil 32 due to direct contact therewith.

Figure 4:
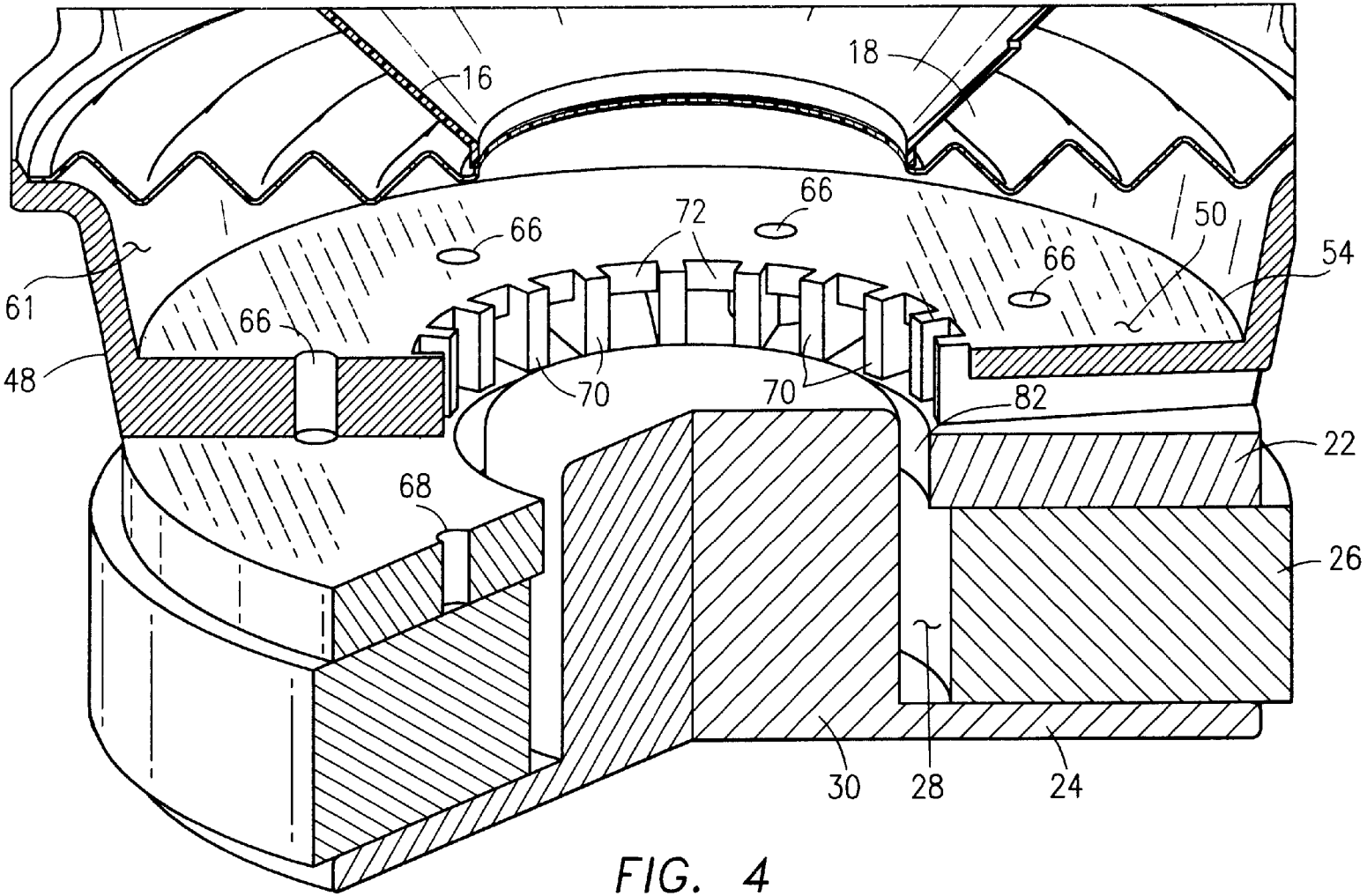
FIG. 4 is cross sectional, perspective view of an alternative embodiment of the cooling structure herein, with the voice coil removed.
Figure 5:
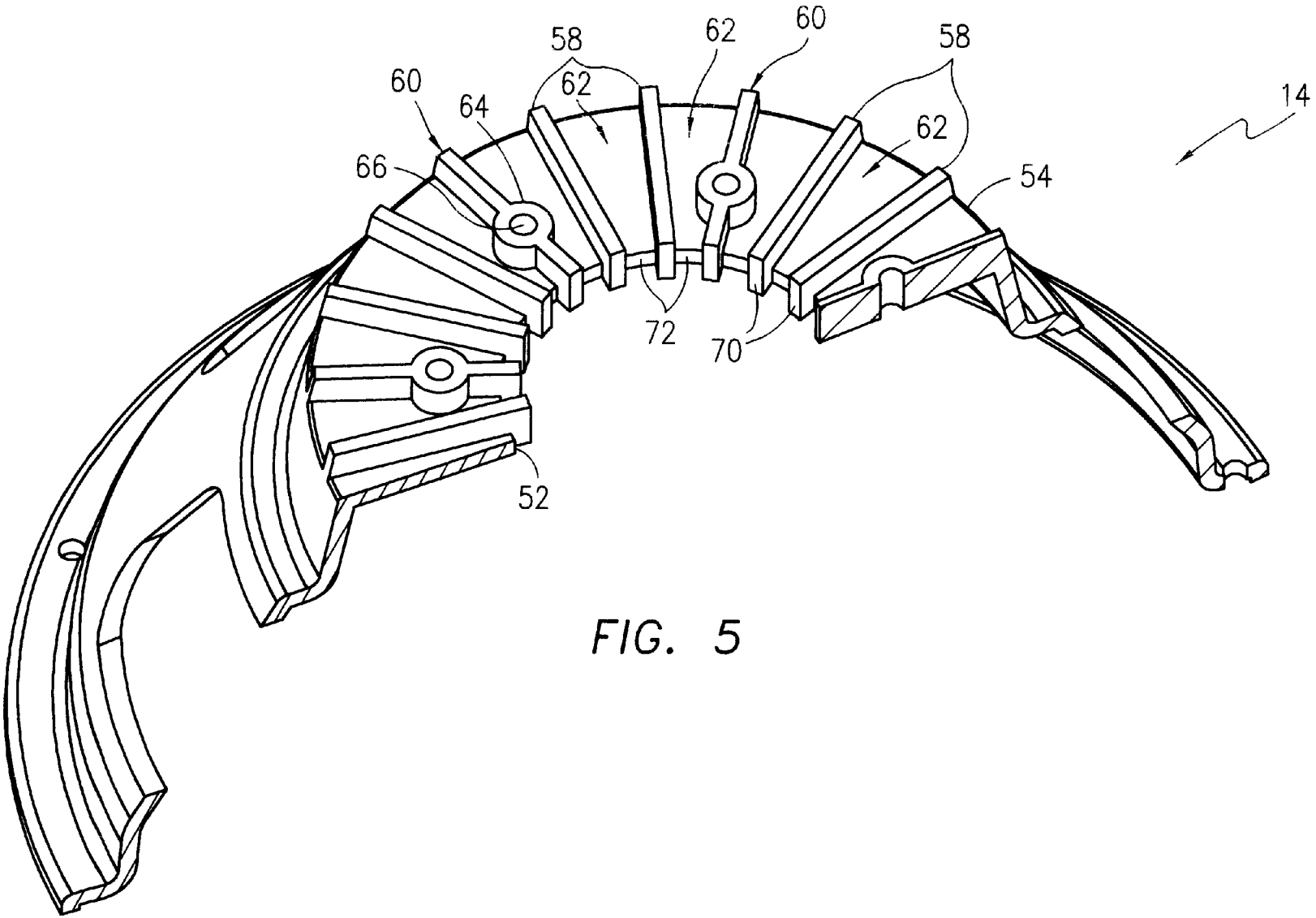
FIG. 5 is bottom perspective view of a portion of the frame shown in FIG. 4.

Referring now the speaker 10 of FIGS. 4 and 5, cooling structure is depicted which is similar to that described in FIGS. 1–3 except in the area of the inner edge 52 of bottom plate 50. In this embodiment, the vanes 58 and 60 each have an inner end 70 which protrudes inwardly beyond the inner edge 52 of bottom plate 50. The inner ends 70 of adjacent vanes 58, 60 form apertures or openings 72 therebetween through which the flow of air within passages 62 is directed in and out of the cavity 61. The structure and operation of the speaker 10 shown in FIGS. 4 and 5 is otherwise the same as that described above in connection with a discussion of FIGS. 1–3.

Figure 6:
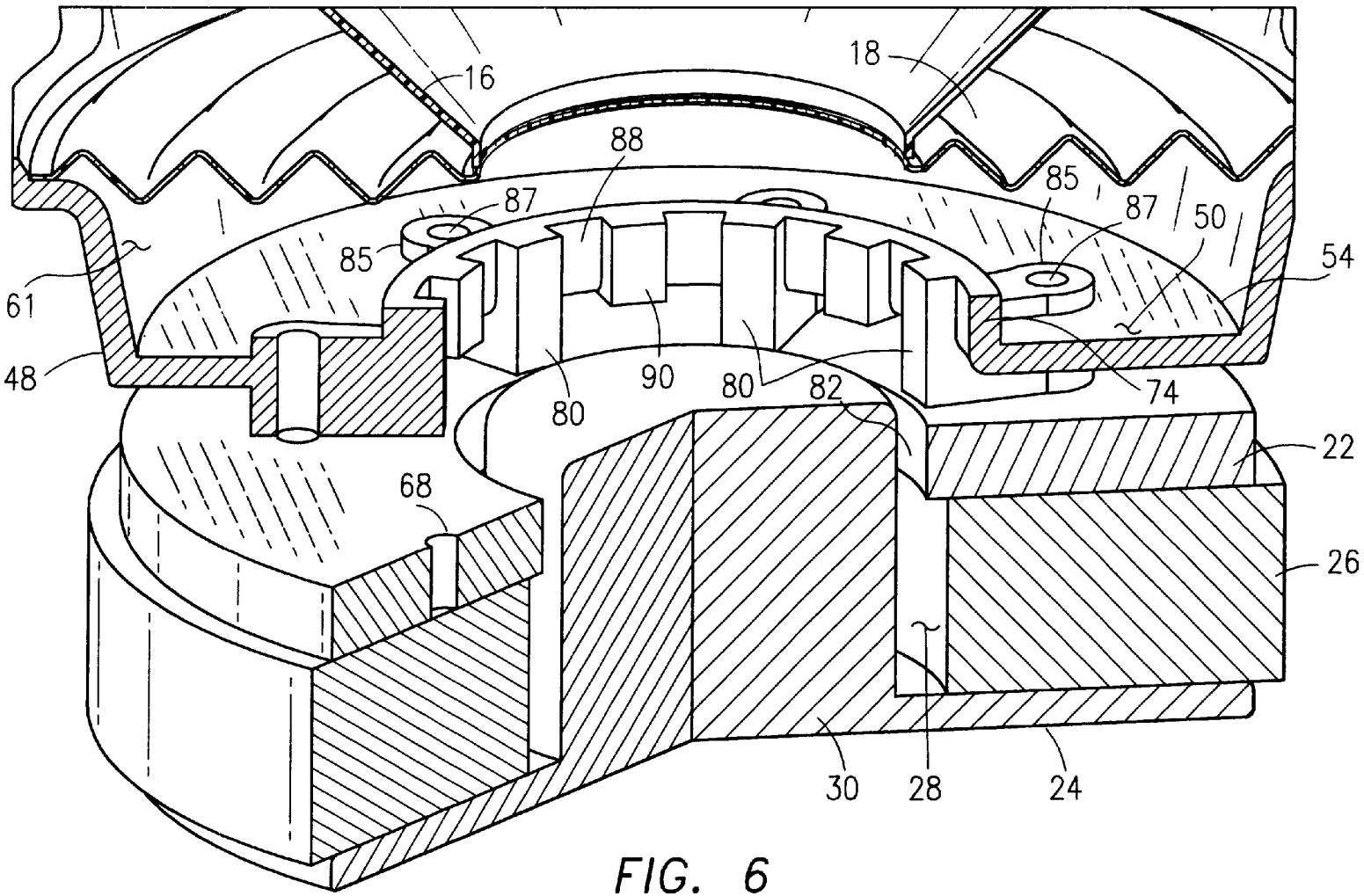
FIG. 6 is a cross sectional, perspective view of a further embodiment of the cooling structure herein, with the voice coil removed.
Figure 7:
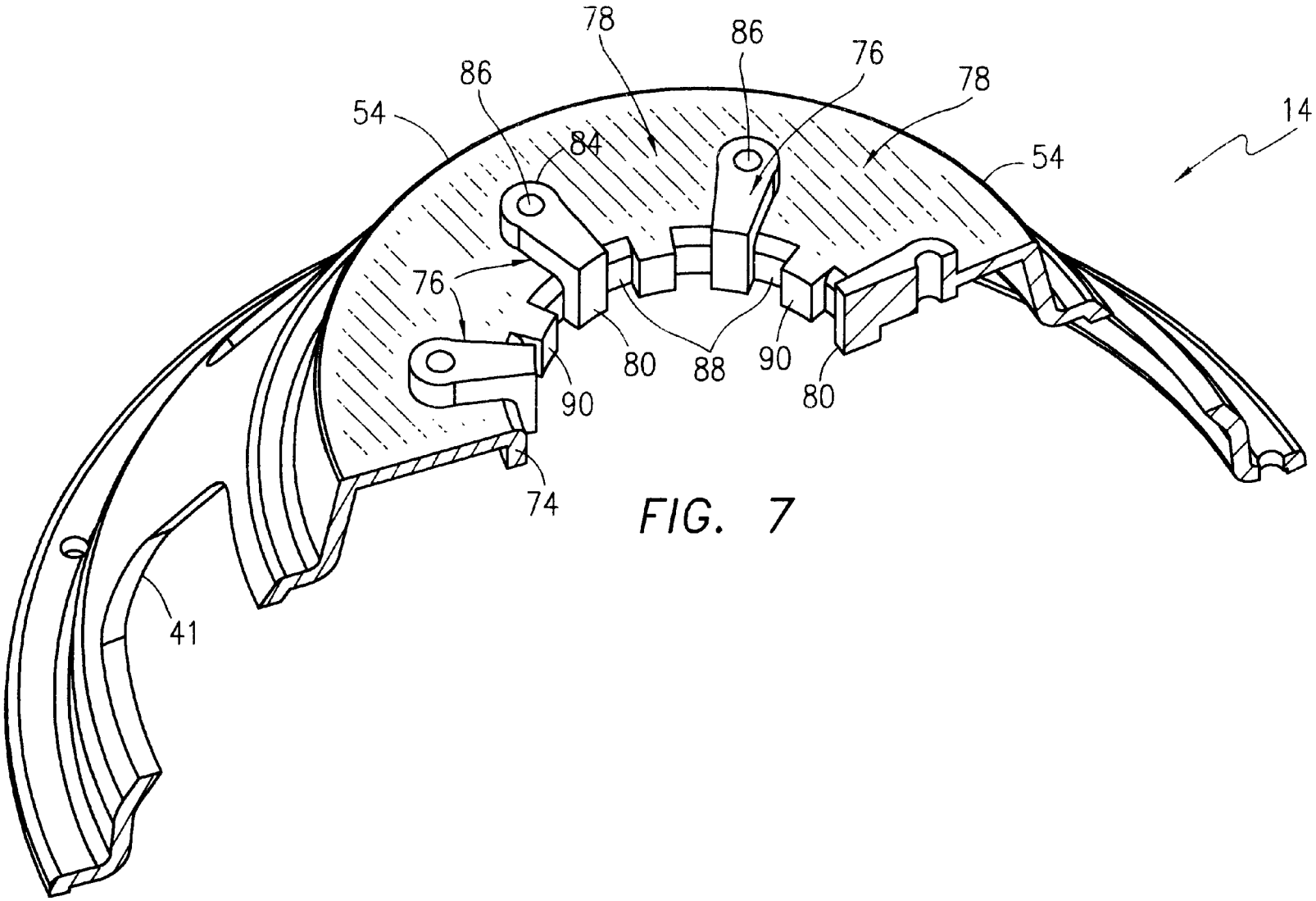
FIG. 7 is a bottom perspective view of a portion of the frame illustrated in FIG. 6.

A further variation of a speaker according to this invention is shown in FIGS. 6 and 7. In this embodiment, the bottom plate 50 is formed with an inner edge defined by a vertically upwardly extending collar 74 which is concentrically disposed about the voice coil 32. A number of bottom vanes 76 are connected to or integrally formed on the lower surface of bottom plate 50, which are spaced from one another defining passages 78 therebetween. Each bottom vane 76 has an inner end 80 which is essentially a vertical plate extending between the collar 74 and the inner diameter 82 of the top plate 22, as best seen in FIG. 6. The bottom vanes 76 are also formed with an outer end 84 having throughbore 86, each of which aligns with a bore 68 in the top plate 22. A like number of top vanes 85 extend from the collar 74 along the top surface of bottom plate 50, and are formed with a bore 87 at their outer end which aligns with the bores 68 and 86. Preferably, the bottom vanes 76 extend only part way along the bottom plate 50, so that their outer ends 84 are spaced from the outer edge 52 of the bottom plate 50. The bores 68, 86 and 87 receive a screw (not shown) for mounting the frame 14 to the top plate 22 as described above in connection with a discussion of the speaker 10 of FIGS. 1–3.

As best seen in FIG. 7, adjacent inner ends 80 of the bottom vanes 76 form curved slots or openings 88 along the collar 74 of bottom plate 50. An extension 90 is located within each of these openings 88 midway between adjacent bottom vanes 76. The extrusions 90 protrude from the collar 74 approximately the same distance as the inner ends 80 of the bottom vanes 76, but are spaced from the surface of the top plate 22. The extensions 90 provide additional metal mass near the voice coil 32, and create more flow paths within the openings 88 for the transmission of air from the passages 78 into and out of the cavity 61.

The heat transfer properties of the speaker 10 shown in FIGS. 6 and 7 are similar to that described above for FIGS. 1–5 in that a flow of air is created within the passages 78 which is directed over the top plate 22, along the bottom vanes 76 and directly into engagement with the voice coil 32 in the course of movement in and out of the cavity 61. Unlike the embodiments of FIGS. 1–5, however, the speaker 10 of FIGS. 6 and 7 has additional metal mass in the area of the voice coil 32 due to the presence of the collar 74, the inner ends 80 of vanes 76 and the extensions 90. These elements conduct more heat away from the voice coil 32 than in the previously described embodiments, but each element is nevertheless exposed to the flow of air in and out of the cavity 61, created by excursion of the voice coil 32, as described in detail above.

Referring now to FIGS. 8–13, a second group of embodiments of a speaker 10 are depicted which are similar to those described above, but which are characterized by the placement of additional metal mass in the area of the voice coil 32.

Figure 8:
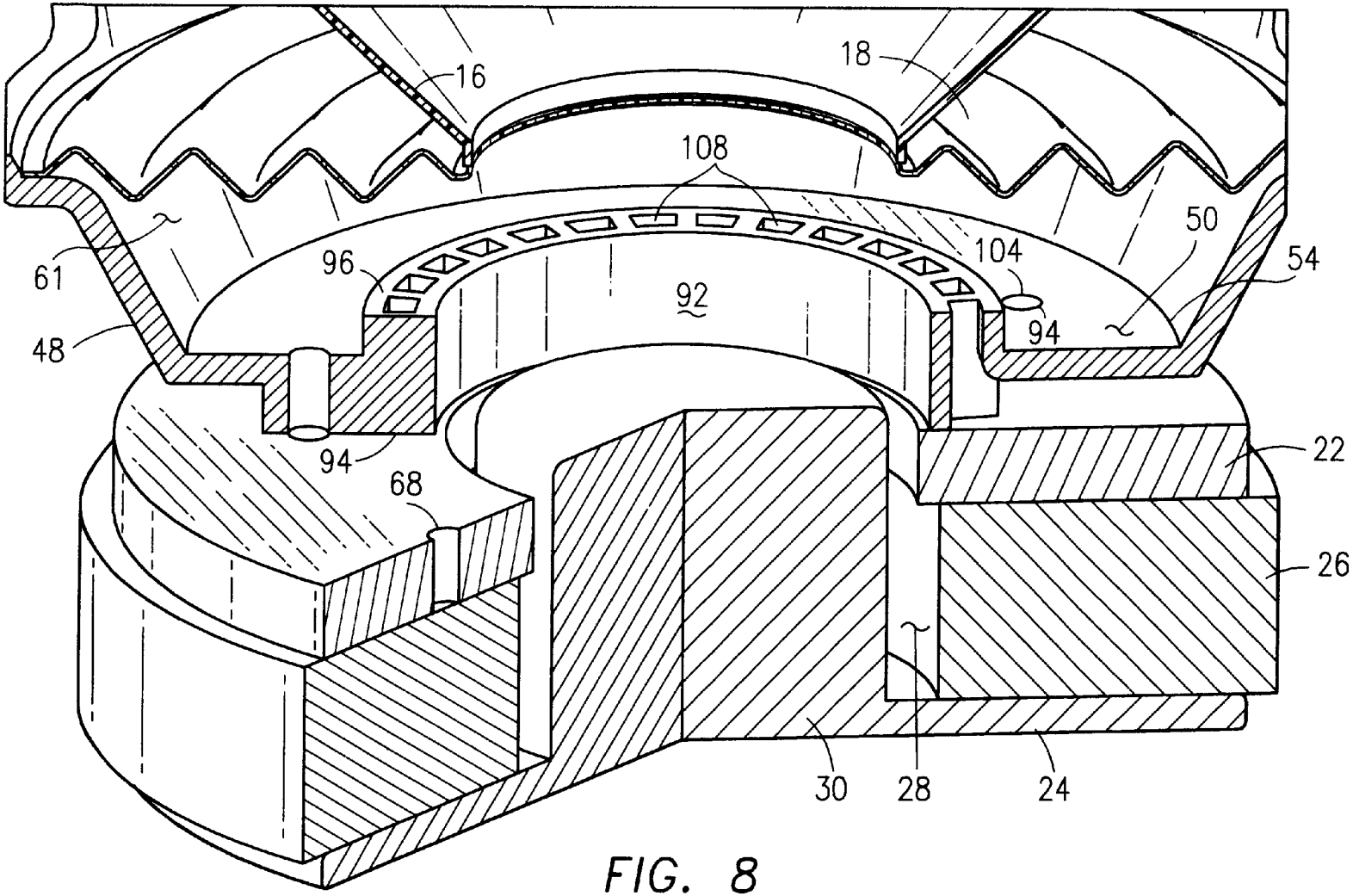
FIG. 8 is cross sectional, perspective view of another embodiment of the cooling structure herein, with the voice coil omitted.
Figure 9:
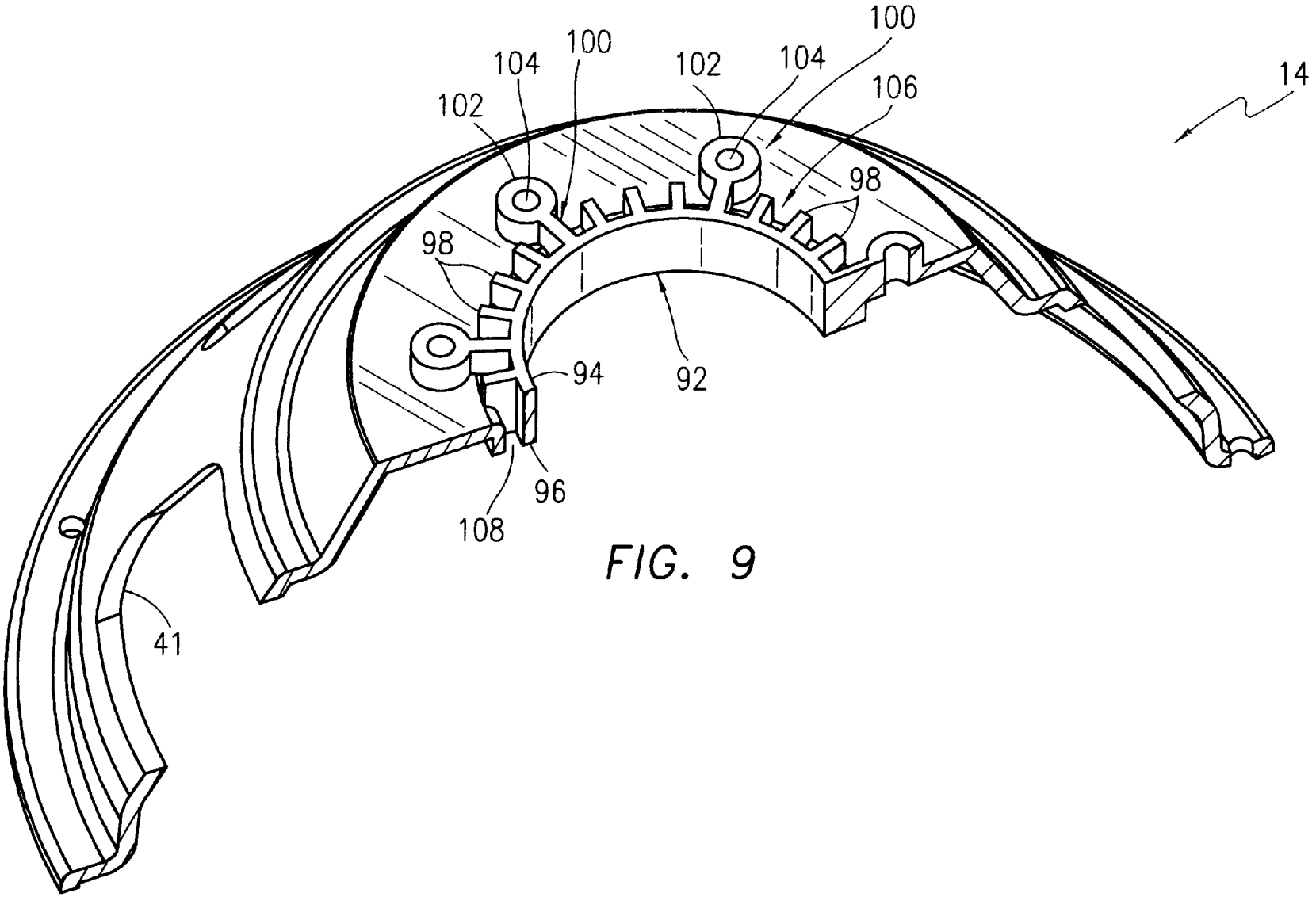
FIG. 9 is a bottom perspective view of a portion of the frame depicted in FIG. 8.
Figure 10:
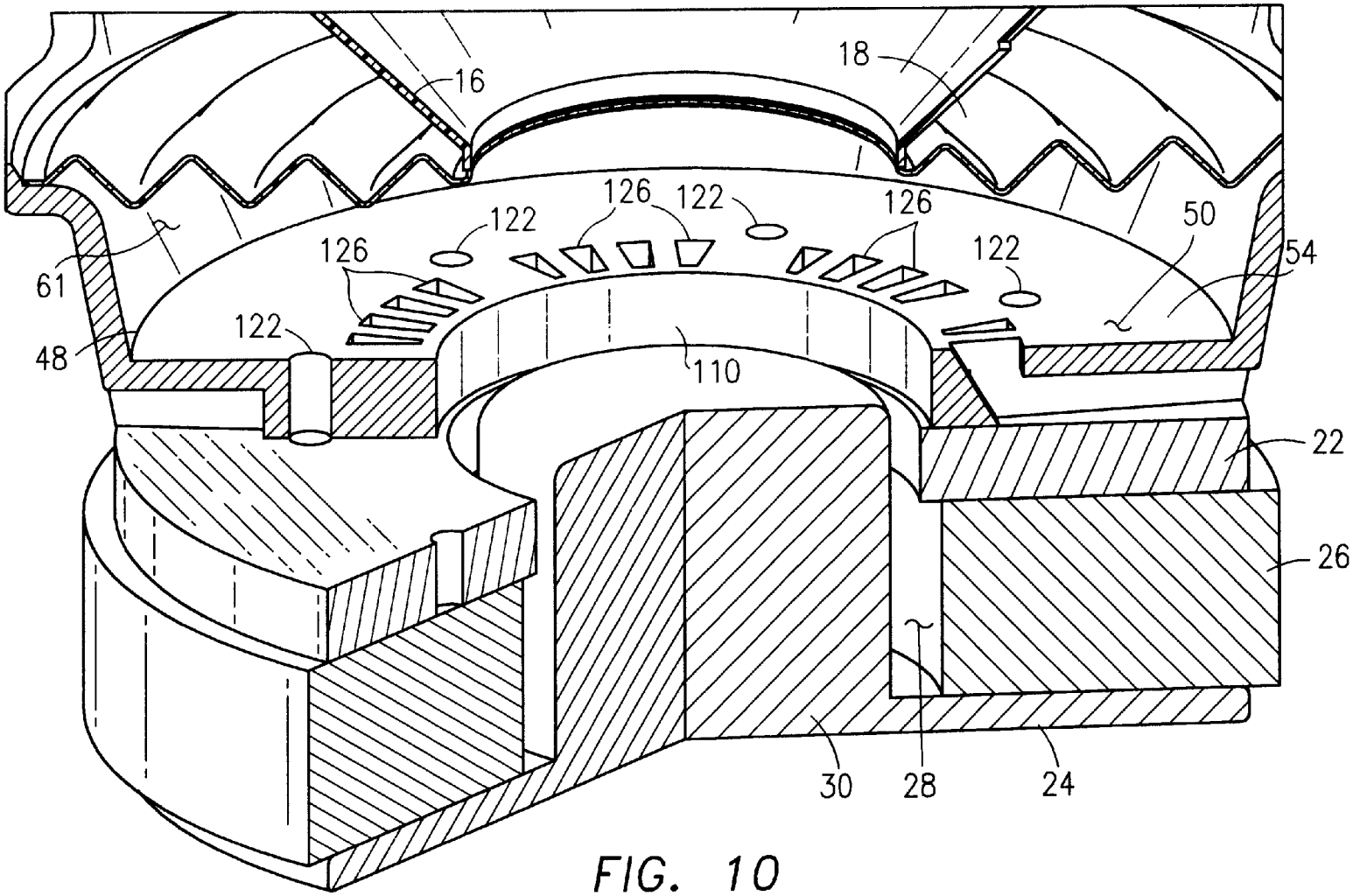
FIG. 10 is cross sectional, perspective view of still another embodiment of the cooling structure of this invention, with the voice coil omitted.

Referring initially to FIGS. 8 and 9, the bottom plate 50 has an inner end formed with an annular ring 92 having a lower edge 94 resting atop the top plate 22 below the plane of the bottom plate 50, and an upper edge 96 which extends above the plane of the bottom plate 50. Such "plane" refers to a horizontal plane passing through the bottom plane 50 as it is oriented in the illustration of FIG. 8. The ring 92 is concentrically disposed about the voice coil 32 and located immediately adjacent to the inner diameter 82 of the top plate 22. A number of first vanes 98 extend outwardly from the ring 92 along the bottom plate 50, and a group of second vanes 100 are located at intervals in between the vanes 98. As best seen in FIG. 9, each second vane 100 has a sleeve 102 at its outer end formed with a throughbore 104 which aligns with a bore 68 in the top plate 22 for mounting of the frame 14 to the top plate 22 in the manner described above. The vanes 98 and 100 are spaced from one another to form passages 106, which, due to the length of the vanes 98 and 100, extend from the ring 92 only part way along the bottom plate 50 toward its outer edge 54. Additionally, the ring 92 is formed with a number of spaced apertures or openings 108, each of which aligns with one of the passages 106 to interconnect them with the cavity 61.

The speaker 10 of FIGS. 8 and 9 operates in essentially the same manner as described above in connection with FIGS. 1–3, except that the flow of air within passages 106 is blocked from impinging directly against the voice coil 32. The intent here is to provide additional heat conducting mass closely adjacent to the voice coil 32, i.e. the ring 92 and vanes 98, 100, and to create a high volume, high velocity flow of air past these elements and in and out of the cavity 61 during speaker operation. The air flow is effective to remove heat from the ring 92 and vanes 98, 100 and thus enhance the heat sink formed by such metal elements.

The embodiments of FIGS. 10–13 function in essentially the same manner as in the speaker 10 of FIGS. 8 and 9, except for variations in the structure of the cooling elements. Considering first the speaker 10 depicted in FIGS. 10 and 11, the bottom plate 50 has an inner edge 110 concentrically disposed about the voice coil 32 and positioned immediately adjacent to the inner diameter 82 of the top plate 22. A heat conducting area 112 extends radially outwardly from the inner edge 110 along a portion of the bottom plate 50, and provides a concentration of metal mass near the voice coil 32. A number of spaced vanes 114 are mounted or integrally formed on the bottom plate 50 between the area 112 and the outer edge 54 thereof, and a group of mounting plates 116 are located at intervals between the vanes 114. Each mounting plate 116 has an inner portion 118 connected to the area 112, and a pair of spaced ribs or vanes 120 extending from the inner portion 118 to the outer edge 54 of bottom plate 50.

The inner portion 118 of each mounting plate 116 has a throughbore 122 which aligns with one of the bores 68 in the top plate 22 for mounting of the frame 14 to the top plate 22 as noted above.

Figure 11:
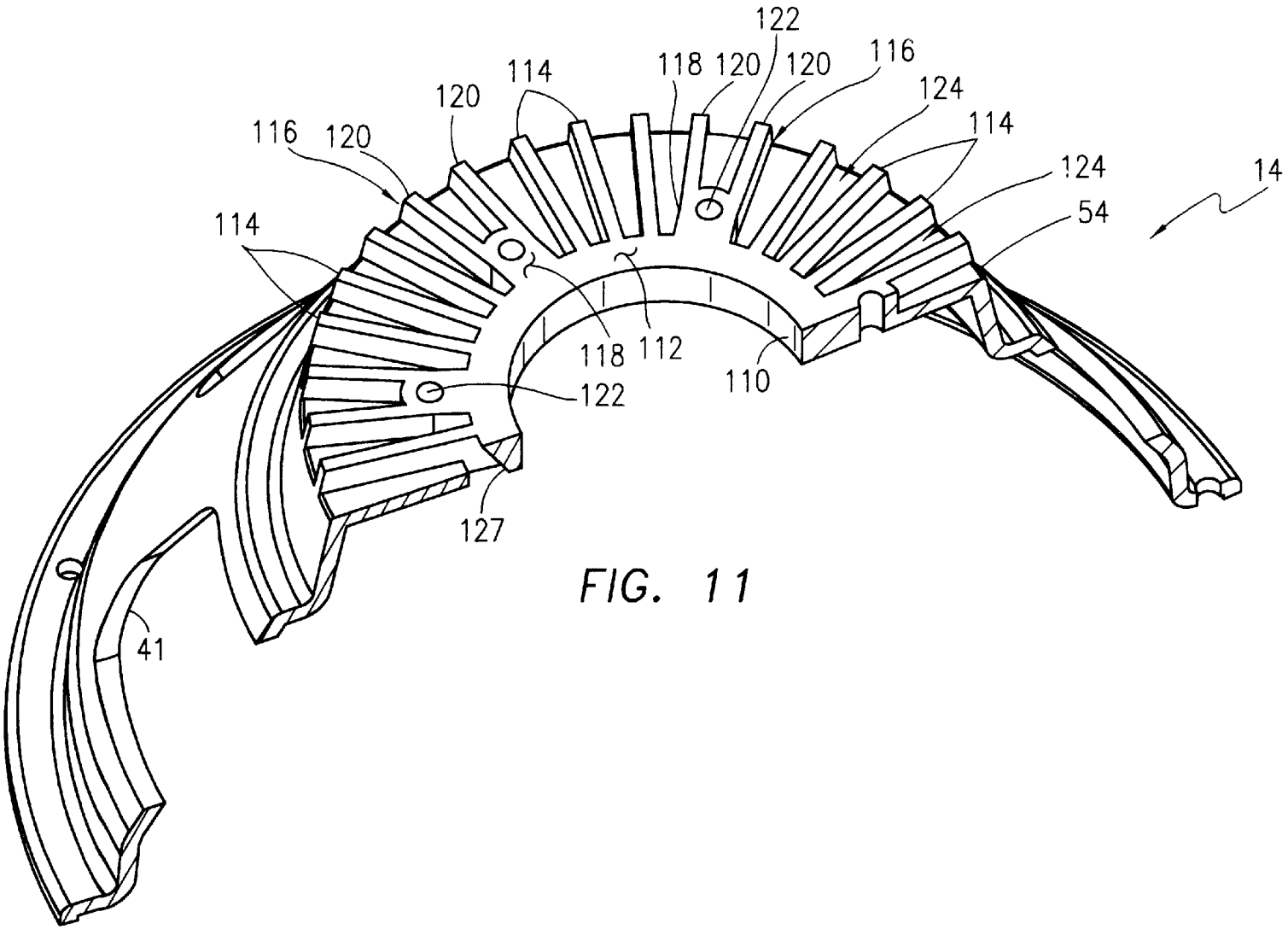
FIG. 11 is a bottom perspective view of a portion of the frame shown in FIG. 10.

The spaces between adjacent vanes 114 form passages 124. These passages 124 are connected to the cavity 61 by a series of apertures or slots 126 which are formed in the bottom plate 50 in alignment with the passages 124. As best seen in FIG. 11, the outer surface or edge 127 of the heat conducting area 112 is tapered or angled in a radially inward direction toward the voice coil 32. Heat is conducted away from the voice coil 32 by the heat conducting area 112, vanes 114 and mounting plates 116 of the bottom plate 50. In response to the movement of voice coil 32 is a vertically upward direction, a flow of air from outside of the speaker 10 is drawn into the passages 124, through slots 126 and flows along the outer edge 127 of area 112. At least a portion of such air flow directly impacts part of the winding 36 of voice coil 32, particularly during high excursion, vertically upward movement of the voice coil 32, due to the angled orientation of outer edge 127. When the voice coil 32 moves in the opposite direction, the air within cavity 61 moves in the reverse direction along the same flow path. As with the embodiment of FIGS. 8 and 9, a comparatively high volume, high velocity air flow in and out of the passages 124, and cavity 61 is developed which greatly assists in transferring heat from the heat conducting elements of the bottom plate 50.

Figure 12:
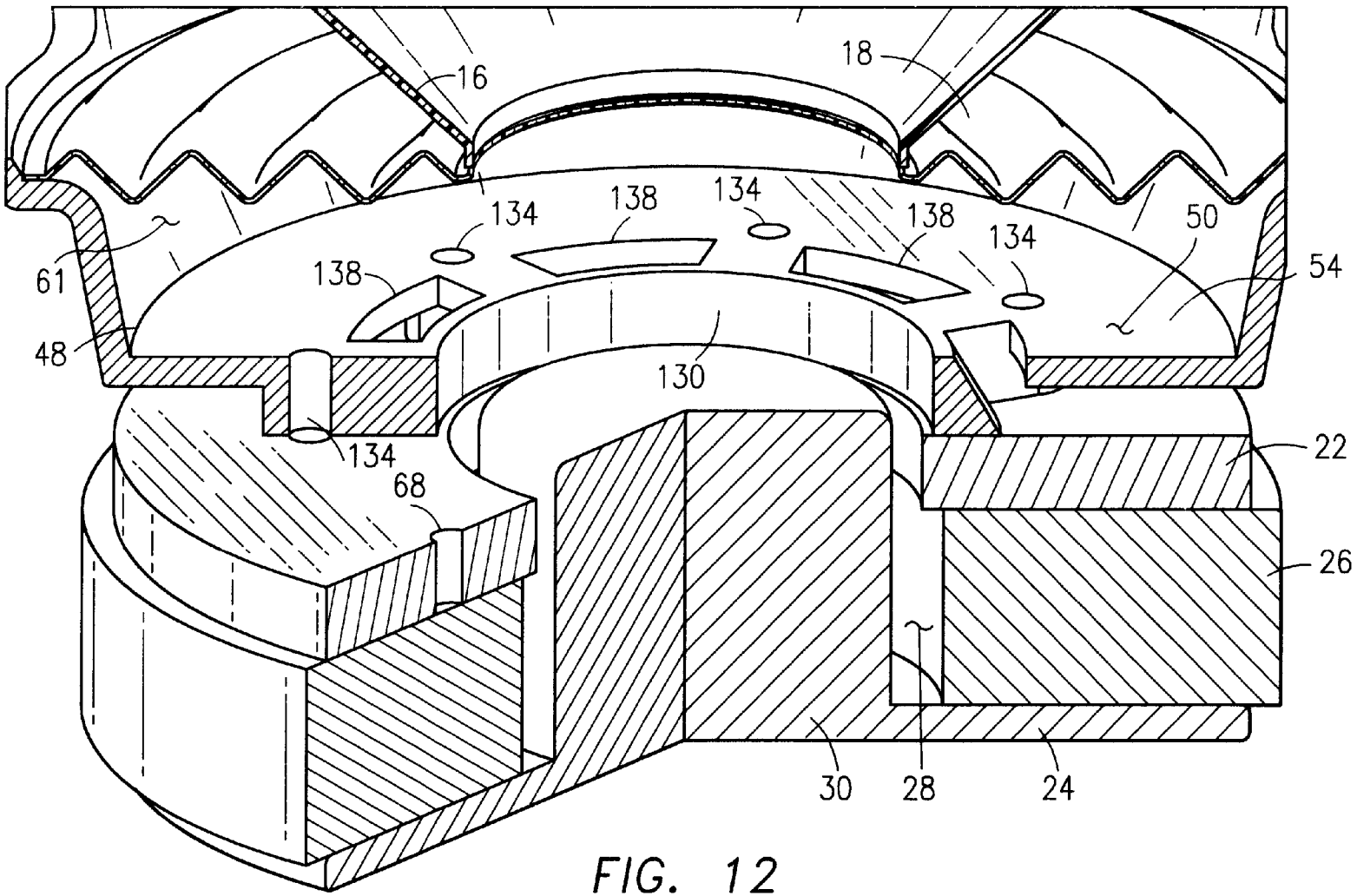
FIG. 12 is a cross sectional, perspective view of a further embodiment of the cooling structure herein, with the voice coil removed.
Figure 13:
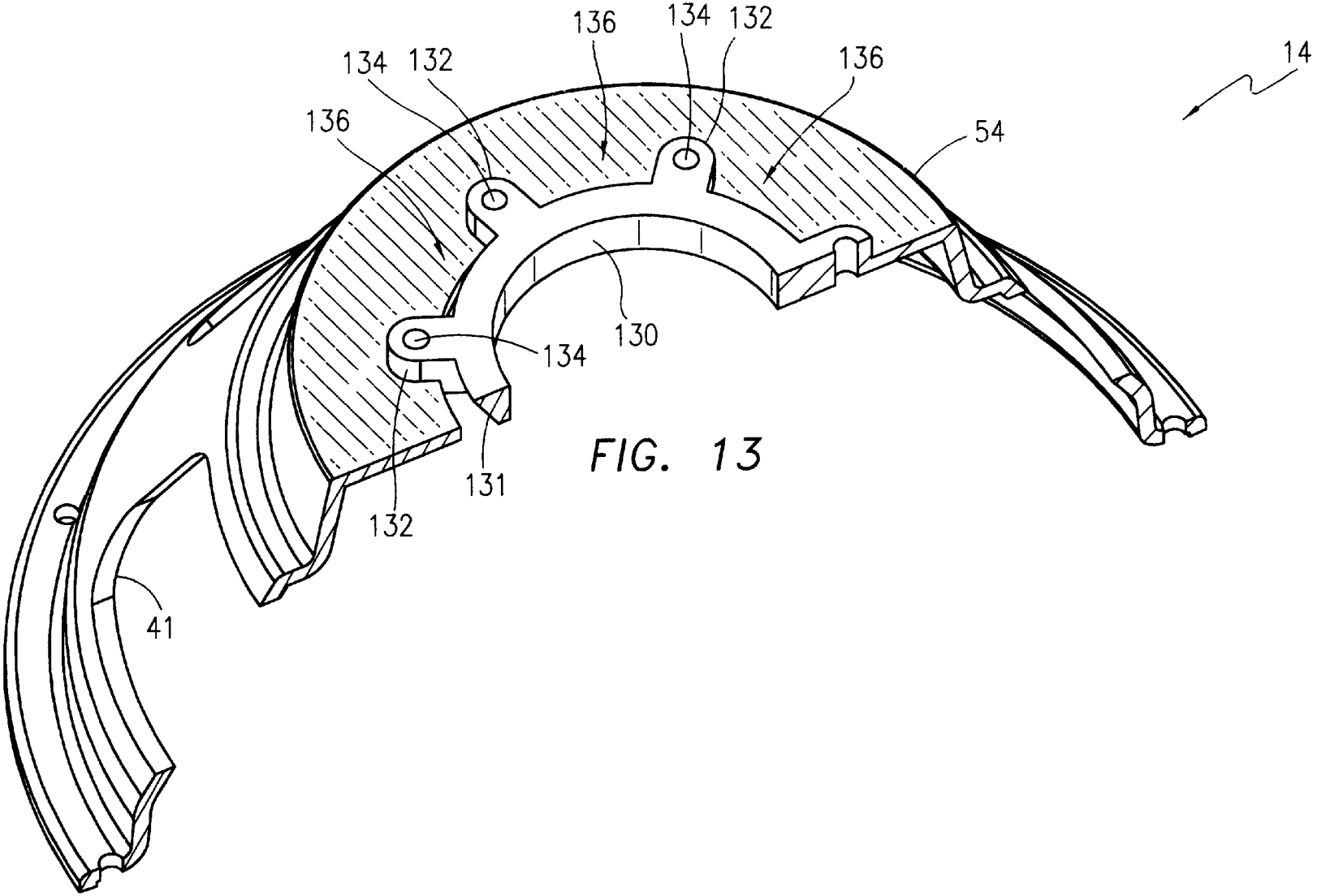
FIG. 13 is a bottom perspective view of a portion of the frame shown in FIG. 12.

The last cooling structure design in the aforementioned second group of embodiments is illustrated in FIGS. 12 and 13. The speaker 10 of this embodiment includes an annular rib 130 which extends vertically downwardly at the inner edge of bottom plate 50 and rests atop the top plate 22 closely adjacent to its inner diameter 82. The annular rib 130 has a tapered, outer edge 131 which is similar in structure and function to the outer edge 127 of heat conducting area 112 described above in connection with speaker 10 of FIGS. 10 and 11. A number of spaced vanes 132 connect to the rib 130 and extend part way along the bottom plate 50 in a direction toward its outer edge 54. Each vane 132 is formed with a throughbore 134 which aligns with a bore 68 in the top plate 22 for mounting of the frame 14 thereto in the manner described above. The spaces between adjacent vanes 132 form passages 136 which are connected to the cavity 61 by elongated, circumferentially extending apertures or slots 138 formed in the bottom plate 50. The heat transfer characteristics of the speaker 10 of FIGS. 12 and 13 is essentially the same as that described above for the speakers 10 of FIGS. 8–11.

Figure 14:
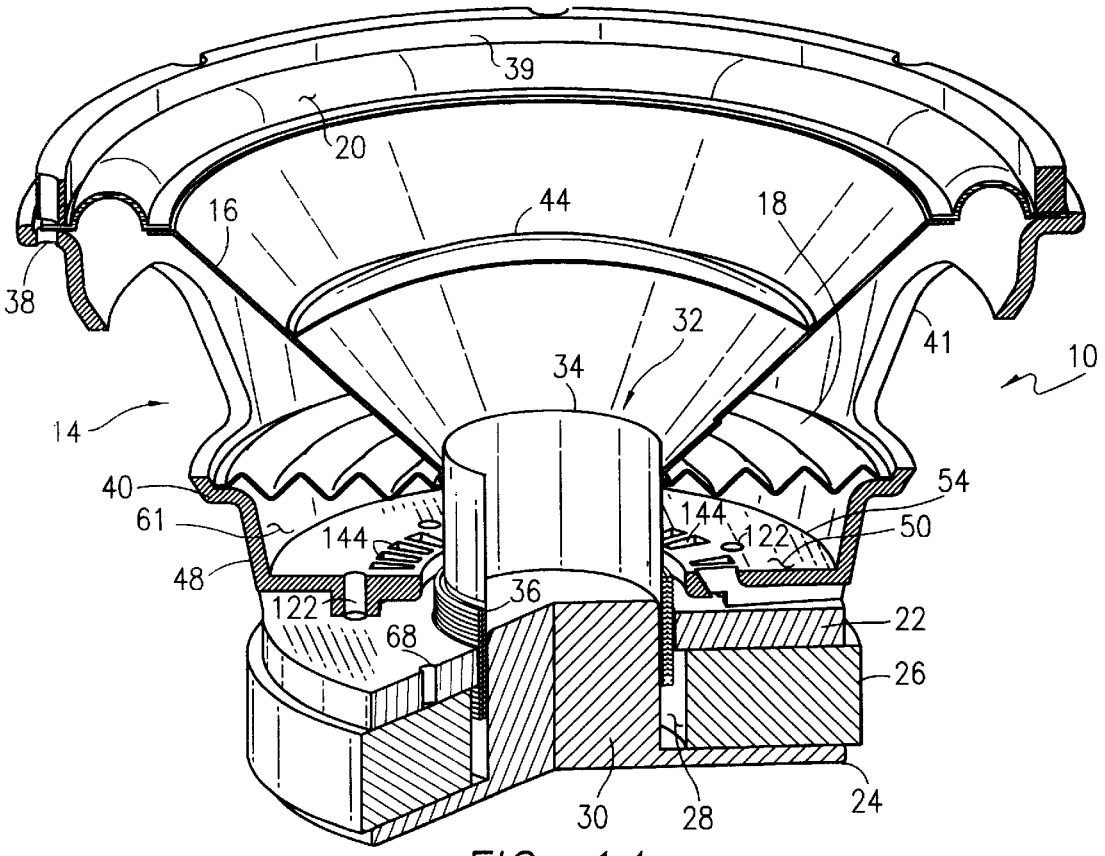
FIG. 14 is a cross sectional, perspective view of a still further embodiment of this invention, depicting a dual flow cooling structure.
Figure 15:
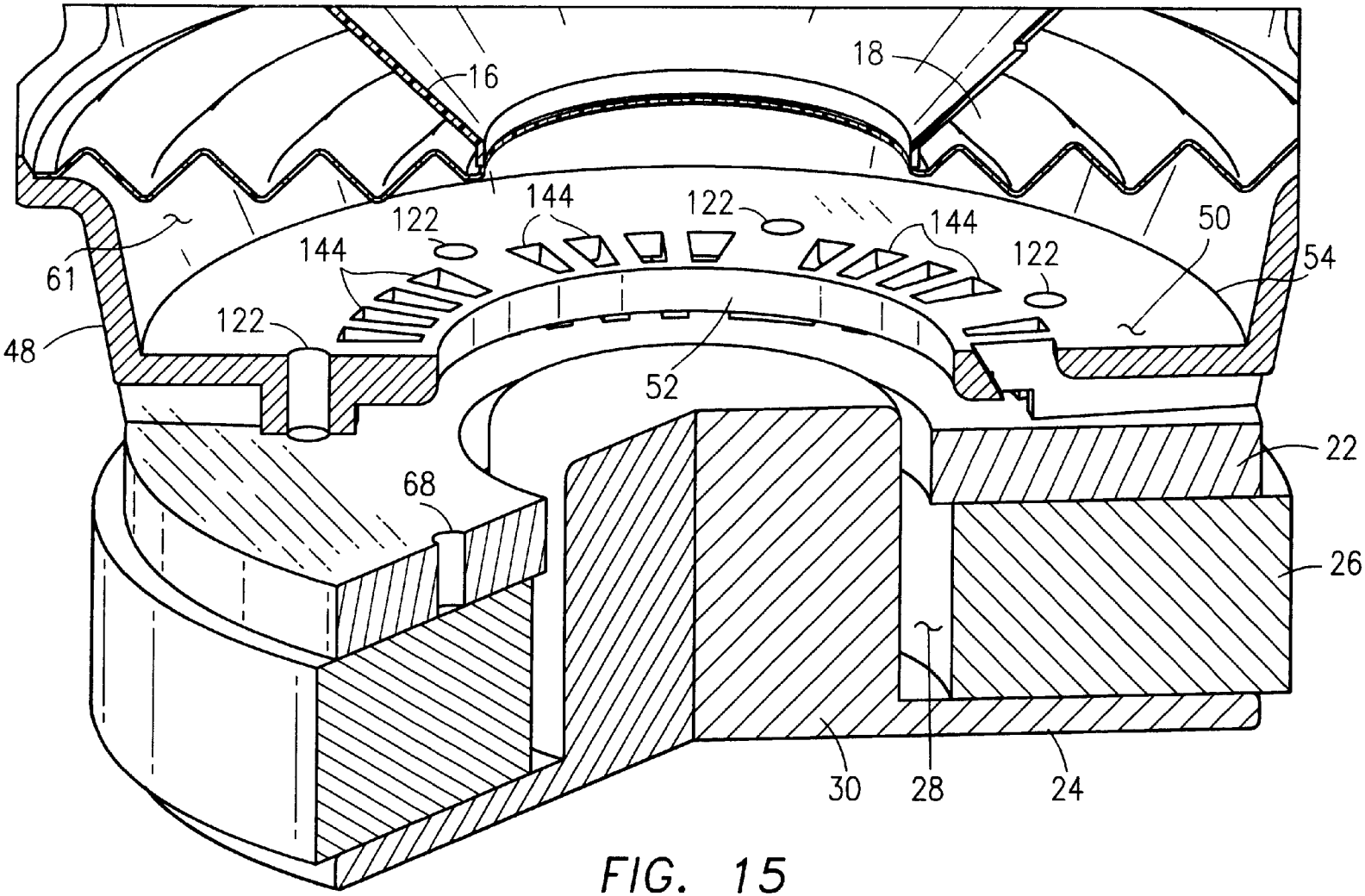
FIG. 15 is a view similar to FIG. 14, except with the voice coil removed.
Figure 16:
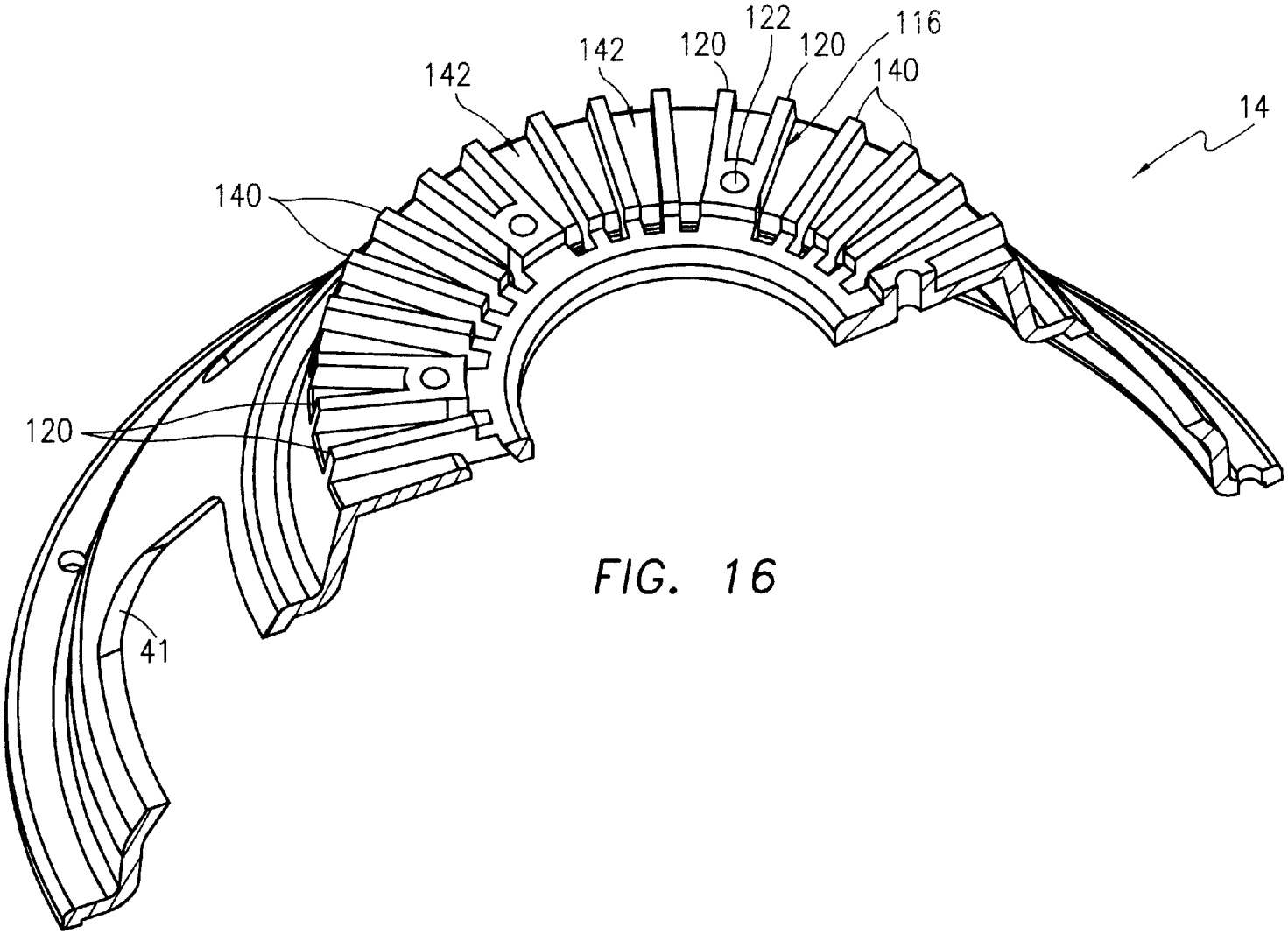
FIG. 16 is a bottom perspective view of a portion of the frame shown in FIGS. 14 and 15.

With reference now to FIGS. 14–16, a still further embodiment of this invention is illustrated which combines, at least to some extent, the heat transfer characteristics of the previously described embodiments. As noted above, the speakers 10 discussed in connection with FIGS. 1–7 provide a flow of air along the top plate 22, directly against the voice coil 32 and in and out of the cavity 61 along the inner edge 52 of the bottom plate. In these embodiments, heat transfer is primarily achieved via the flow of air past the voice coil 32, and to a lesser extent along surfaces of the bottom plate 50 of the frame 14 and top plate 22 of the motor 12 which conduct heat from the voice coil 32. The speakers 10 depicted in FIGS. 8–13, on the other hand, depend to a much greater extent on heat conduction resulting from the placement of additional metal mass immediately adjacent to the voice coil 32. The flow of air through the passages in these embodiments is blocked from direct contact with the voice coil 32, and instead is primarily intended to remove heat by flowing along the heat conducting elements of such speakers.

The embodiment of speaker 10 shown in FIGS. 14–16 is designed to include additional metal mass adjacent to the voice coil 32, but to also create an air flow directly against the voice coil 32. The inner edge 52 of the bottom plate 50 encircles the voice coil 32 and is close enough to conduct at least a limited amount of heat therefrom. A number of spaced vanes 140 are mounted or integrally formed on the bottom plate 50, beginning at a location spaced from its inner edge 52 and extending to the outer edge thereof Mounting plates 116, identical to those described above in connection with a discussion of FIGS. 10 and 11, are located at intervals in between the vanes 140. The spaces between adjacent vanes 140, and the vanes 120 associated with mounting plates 116, define passages 142 which are connected to the cavity 61 by apertures or slots 144 formed in the bottom plate 50 in alignment therewith.

The speaker 10 of FIGS. 14–16 develops a flow of air along essentially two flow paths, at least in the area of the voice coil 32. Air entering and leaving the cavity 61 by excursion of the voice coil 32 as described above, moves along a flow path defined by the passages 142 and slots 144. In the area near the voice coil 32, the inner end of each passage 142 is open to permit the flow of air directly against the voice coil 32, in a manner similar to the embodiments of FIGS. 1–7. Additionally, a portion of such air flow through the passages 142 enters the slots 144, and is effective to transfer heat away from the inner portion of the bottom plate 50 which has conducted heat from the voice coil 32, such in a manner similar to that described in the embodiments of FIGS. 8–13. As such, this "dual flow" aspect of the speaker 10 in FIGS. 14–16 employs a combination of the heat transfer characteristics of the previous embodiments.

Referring now to FIGS. 17–24, a still further group of embodiments of the cooling structure of this invention is illustrated. In the previously described speakers 10 depicted in FIGS. 1–16, the lower end 42 of frame 14 includes a bottom plate 50 integrally formed with a variety of different configurations of vanes, mounting plates, rings and passages in between the vanes. The vanes and mounting plates rest directly atop the top plate 22 of motor structure 12. The embodiments of the speaker 10 depicted in FIGS. 17–24 include closely related cooling structure, except that the vanes and mounting plates are formed as part of a separate "attachment" element which is mounted in between a flat bottom plate 150 or 160, and the top plate 22 of motor structure 12. As described below, the various attachments shown in the embodiments of FIGS. 17–24 are essentially identical to the bottom plates 50 of the speaker 10 depicted in certain of the embodiments of FIGS. 1–16. Consequently, the same reference numbers used to describe the structure of various bottom plates 50 in FIGS. 1–16 are used to denote the same structure in FIGS. 17–24.

Figure 17:
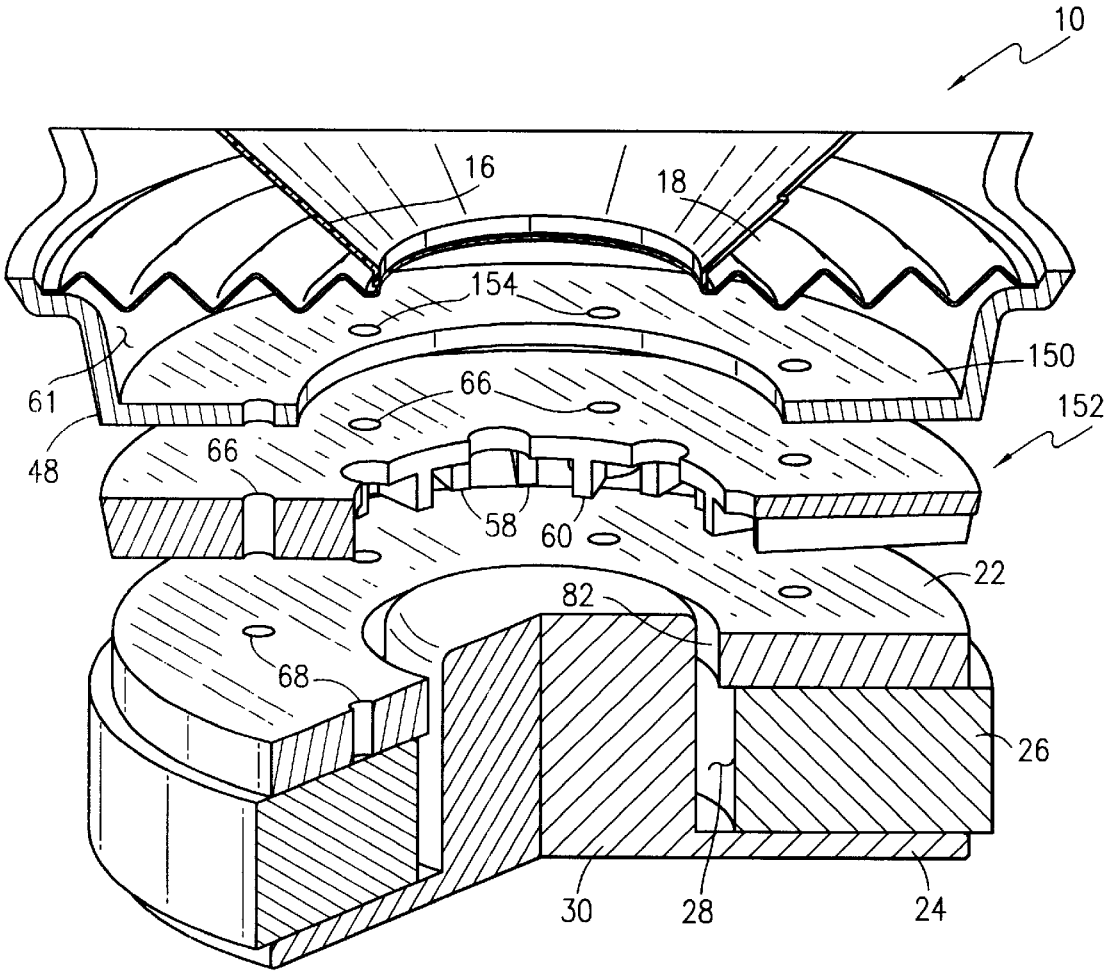
FIG. 17 is an exploded, cross-sectional perspective view of a further embodiment of the cooling structure of this invention, with a voice coil removed.
Figure 18:
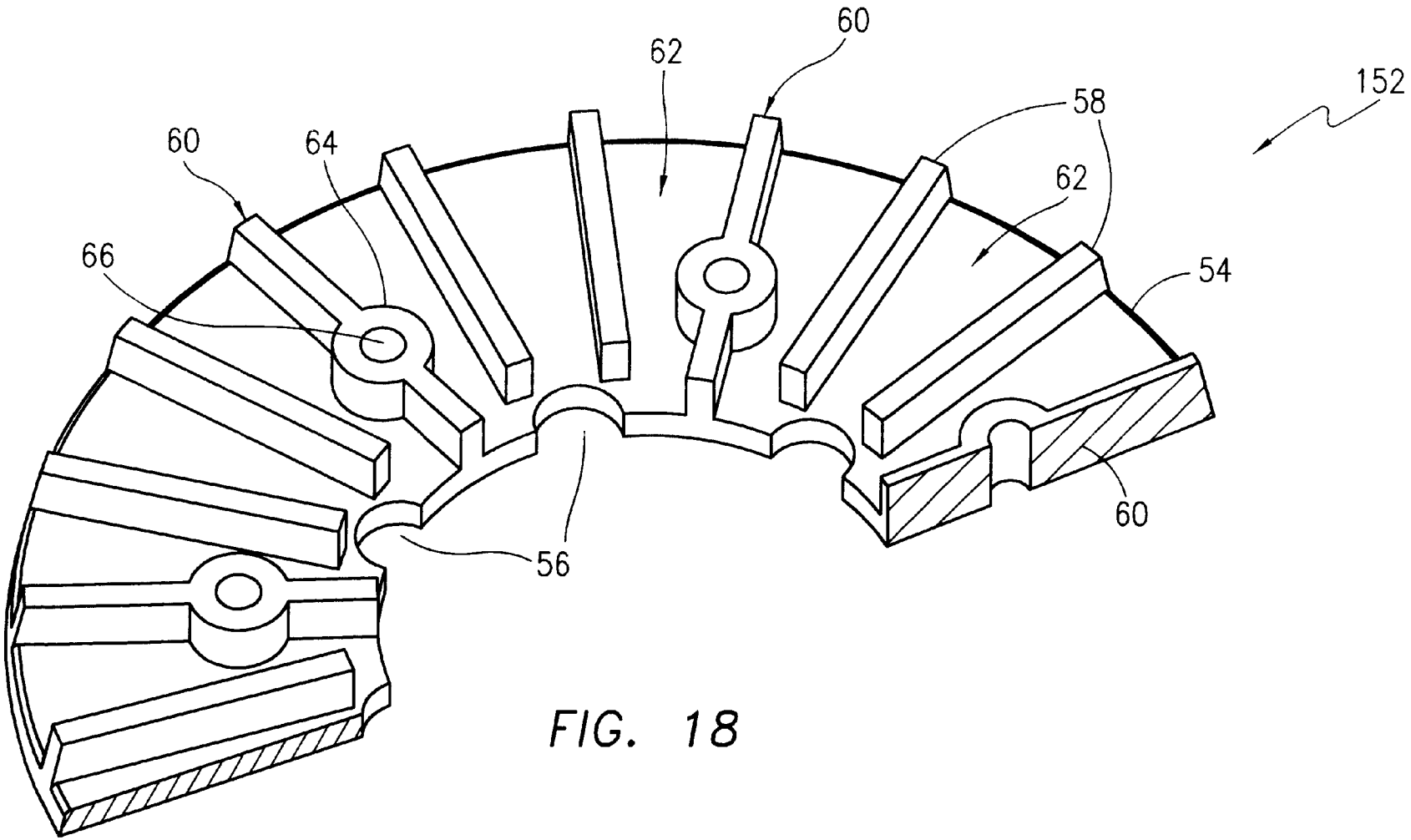
FIG. 18 is a bottom perspective view of the attachment depicted in FIG. 17.

Referring initially to FIGS. 17 and 18, a speaker 10 is illustrated having an attachment 152 mounted in between the bottom plate 150 of the frame 14 and the top plate 22 of motor structure 12. The attachment 152 has a vane construction identical to that depicted on the bottom surface of bottom plate 50 in FIGS. 2 and 3 as described in detail above. The same reference numbers used in FIGS. 2 and 3 are therefore applied to identify the same structure in FIGS. 17 and 18. In order to interconnect the bottom plate 150, attachment 152 and top plate 22, the bottom plate 150 is formed with mounting holes 154 which align with the bores 66 in attachment 152 and the bores 68 in the top plate 22, all of which receive screws (not shown). The heat conducting characteristics of the speaker 10 shown in FIGS. 17 and 18 are identical to that described above in connection with FIGS. 2 and 3.

Figure 19:
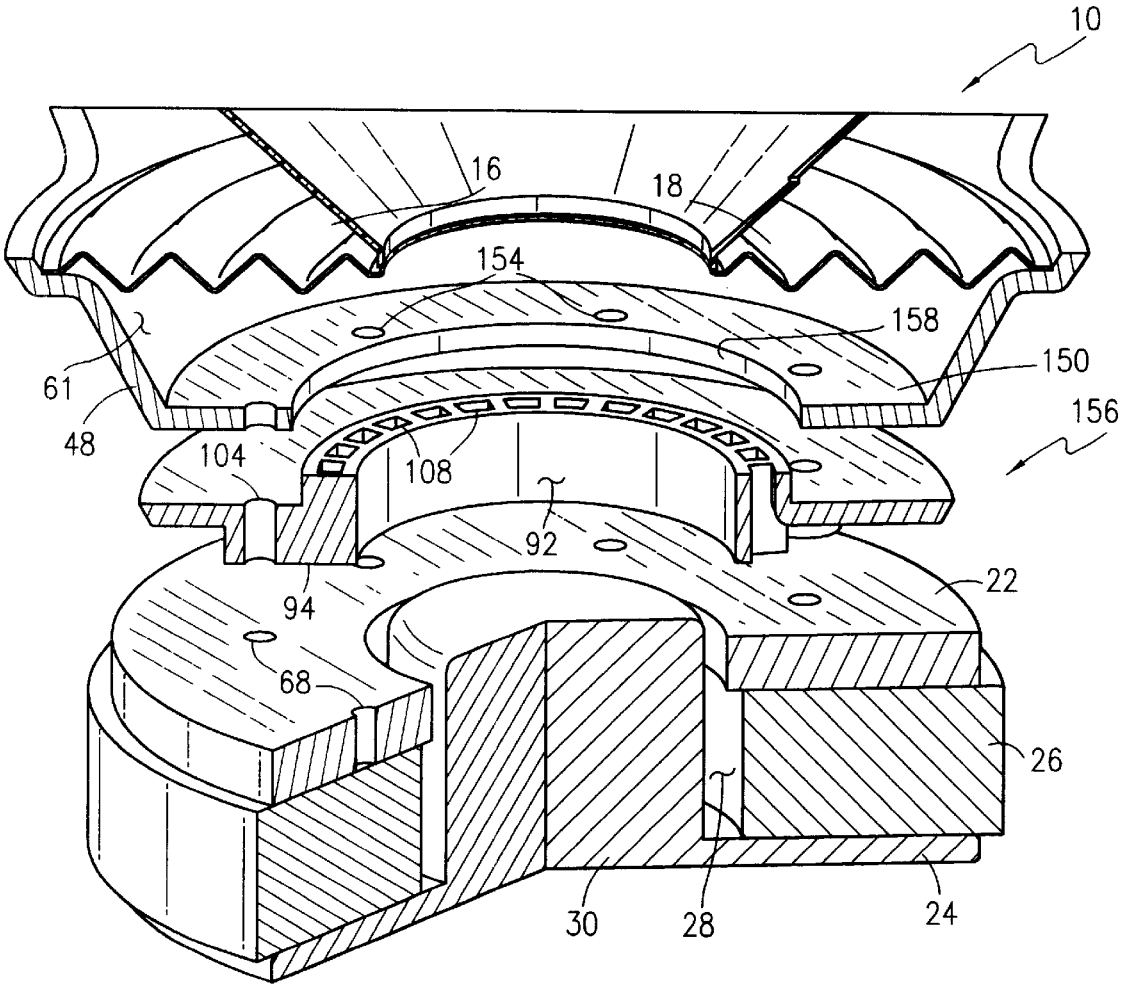
FIG. 19 is an exploded, cross-sectional perspective view of another embodiment with the cooling structure herein, with the voice coil removed.
Figure 20:
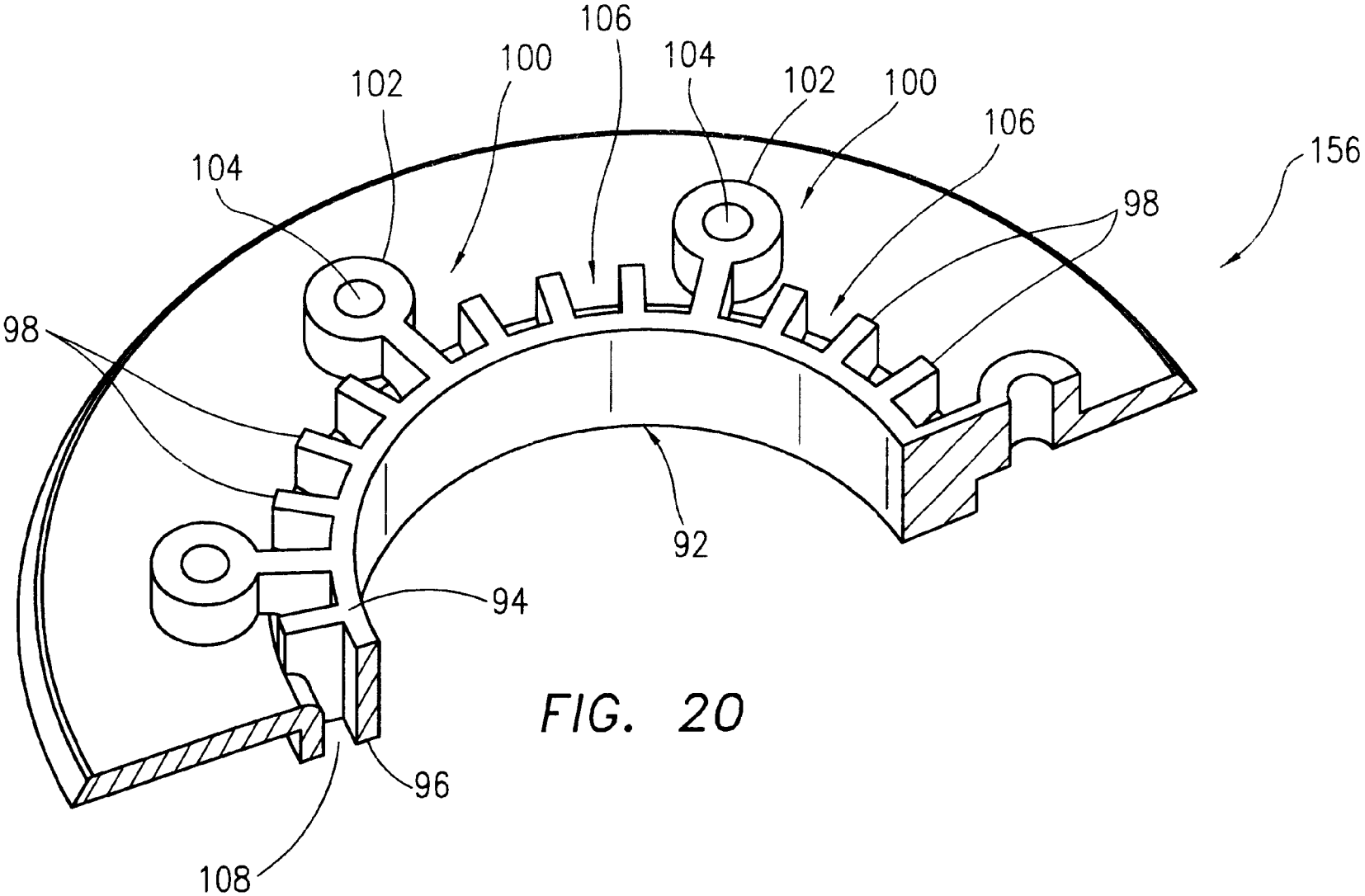
FIG. 20 is a bottom perspective view of the attachment shown in FIG. 19.

The embodiment of speaker 10 shown in FIGS. 19 and 20 includes an attachment 156 which is essentially the same as the bottom plate 50 depicted in FIGS. 8 and 9 described above. In this embodiment, the attachment 156 is interposed between the bottom plate 150 and top plate 22 such that the inner edge 158 of bottom plate 150 rests against the ring 92 of attachment 156. The heat transfer characteristics of the speaker 10 depicted in FIGS. 19 and 20 is otherwise identical to that described above in connection with FIGS. 8 and 9.

Figure 21:
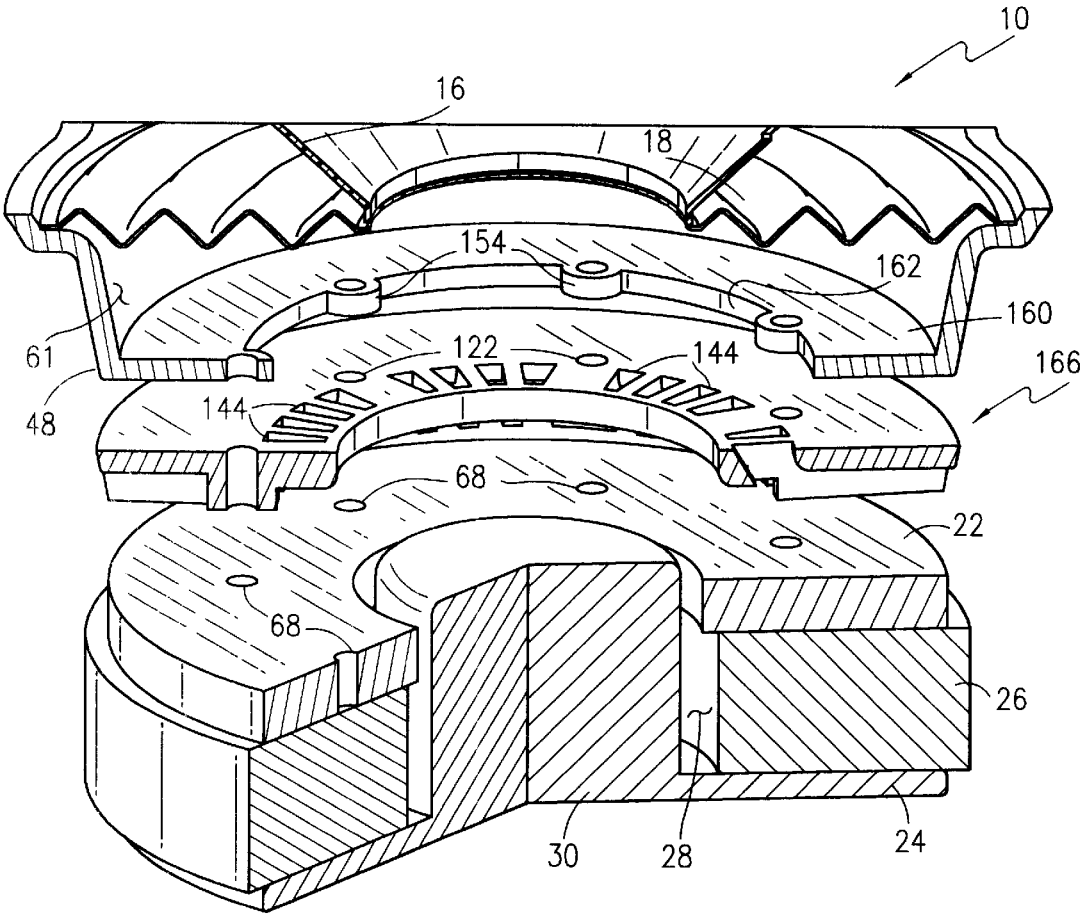
FIG. 21 is an exploded, cross-sectional perspective view of still another embodiment of this invention, with the voice coil removed.
Figure 22:
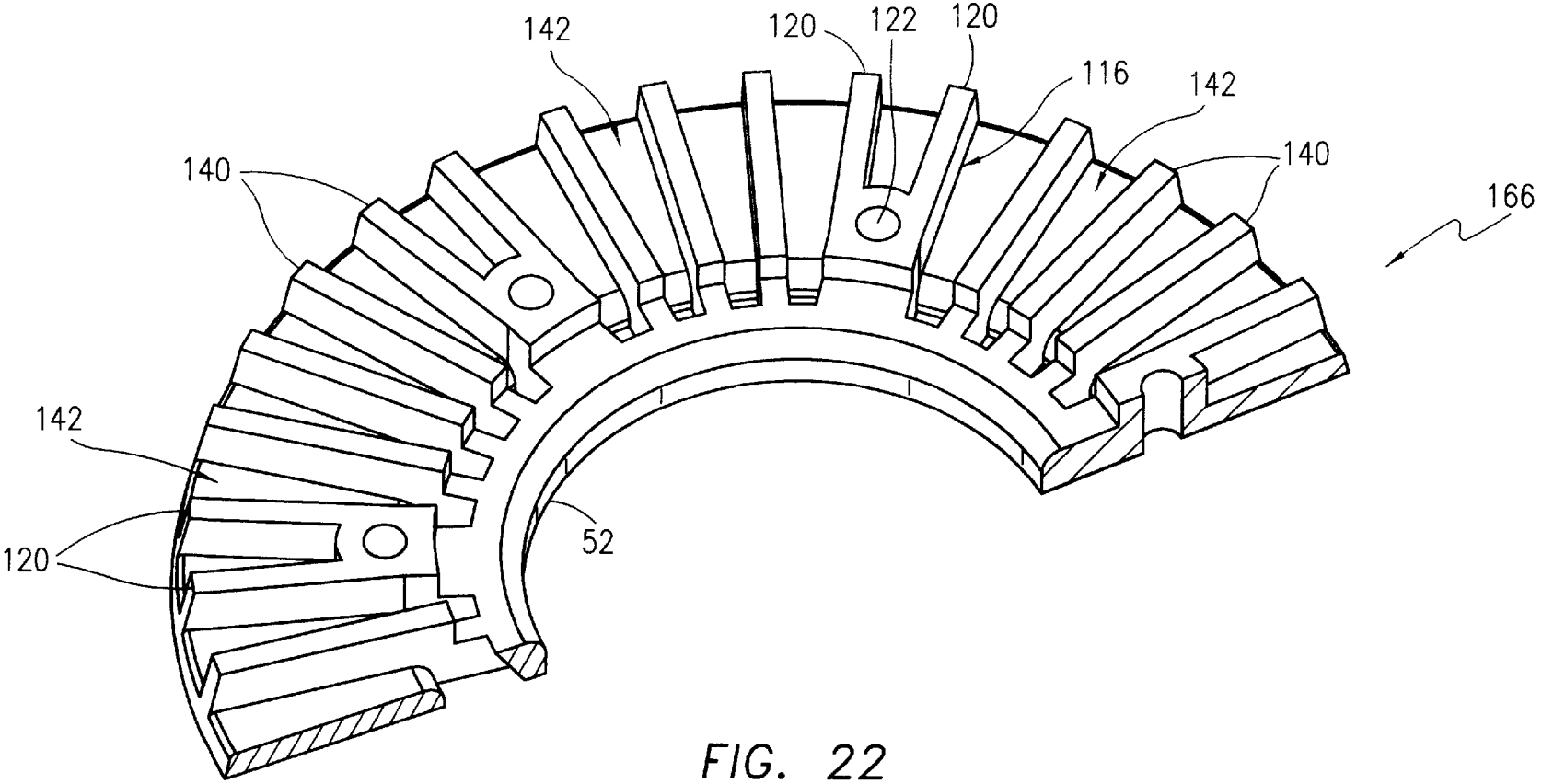
FIG. 22 is a bottom perspective view of the attachment of FIG. 21.

With reference to FIGS. 21 and 22, a modified bottom plate 160 of the frame 14 is provided having an inner diameter 162 formed with a number of circumferentially spaced bosses 164 each having a throughbore 168. The bottom plate 160 rests atop an attachment 166 which is essentially identical to the bottom plate 50 depicted in FIGS. 15 and 16 described in detail above. In the assembled position, the throughbore 168 of each boss 164 aligns with a bore 122 formed in attachment 166, and, in turn, a bore 68 in top plate 22. The heat transfer characteristics of the embodiment of speaker 10 shown in FIGS. 21 and 22 are otherwise identical to that described above in connection with FIGS. 15 and 16.

Figure 23:
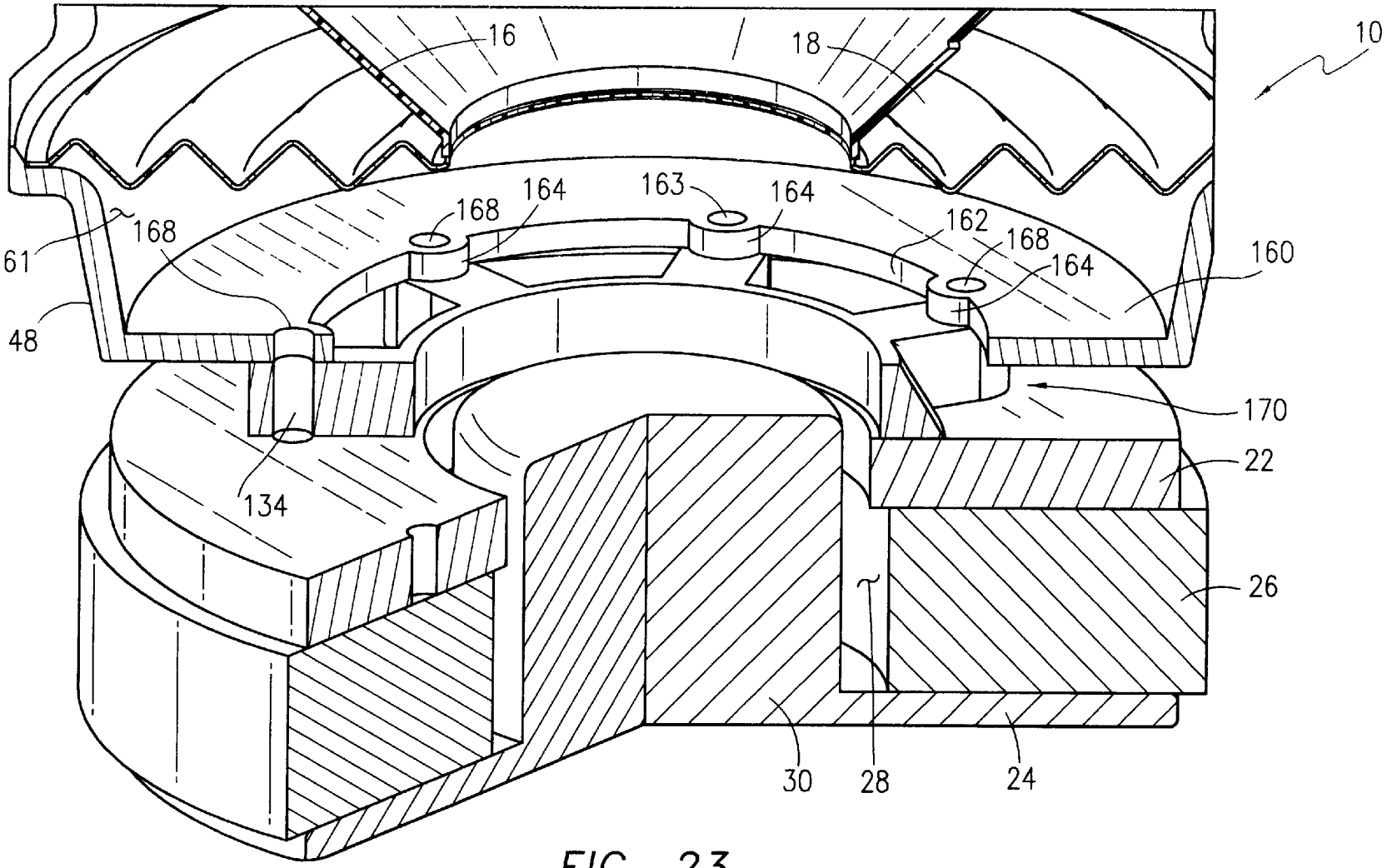
FIG. 23 is a cross-sectional perspective view of a further embodiment of the cooling structure herein, with the voice coil removed.
Figure 24:
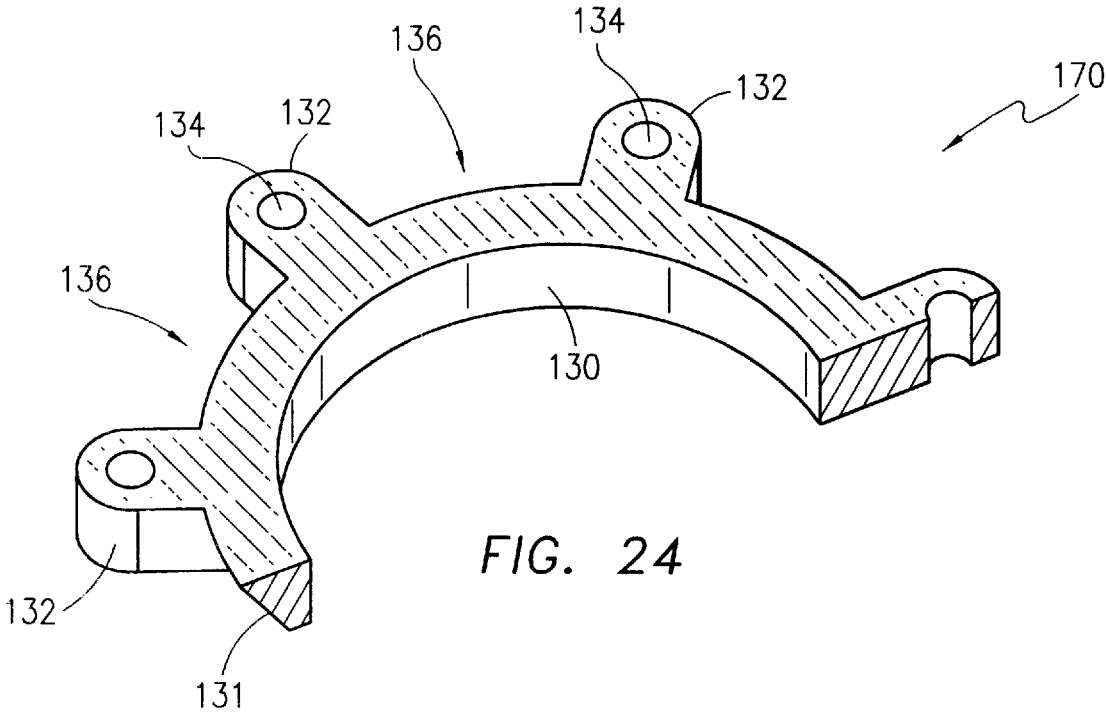
FIG. 24 is a bottom perspective view of the attachment depicted in FIG. 23.

Finally, a speaker 10 is depicted in FIGS. 23 and 24 which is similar to that disclosed in FIGS. 12 and 13 above. This embodiment employs the same bottom plate 160 of FIGS. 21 and 22, which is mounted atop an attachment 170 comprising an annular rib 130 and vanes 132 identical to those described above in connection with the discussion of the bottom plate 50 of FIGS. 12 and 13. The offset between the inner diameter 162 of bottom plate 160, and the annular rib 130 of attachment 170, defines slots 138 as seen in FIG. 12. Additionally, the annular rib 130 has a tapered, outer edge 131, as in the embodiment of FIG. 12. The heat transfer characteristics of the speaker 10 illustrated in FIGS. 23 and 24 is therefore the same as that described above for FIGS. 12 and 13.

While the invention has been described with reference to a preferred embodiment, it should be understood by those skilled in the art that various changes may be made in equivalents and may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the intended claims.

What is claimed is:

1. A loudspeaker comprising:

a motor including a top plate having an upper surface, and a movable voice coil;

a frame including an upper end, and a lower end formed with a bottom plate having an inner edge and an outer edge spaced from said inner edge;

a surround connected to said upper end of said frame and a diaphragm connected between said surround and said voice coil;

a lower suspension connected at one end to said voice coil, and at the other end to said frame at a location between said upper and lower ends of said frame, a cavity being formed in the area between said lower suspension and said bottom plate of said frame;

cooling structure including a number of spaced vanes located between said bottom plate of said frame and said upper surface of said top plate of said motor, adjacent vanes forming passages therebetween which are connected to said cavity by a number of apertures formed along said inner edge of said bottom plate, said passages and said apertures being positioned to direct a flow of air in and out of said cavity, in response to movement of said voice coil, along a flow path formed between said bottom plate of said frame and said upper surface of said top plate of said motor, said flow of air being directed along said flow path in thermal communication with said top plate and said voice coil of said motor.

2. The loudspeaker of claim 1 in which each of said vanes is connected to said bottom plate of said frame.

3. The loudspeaker of claim 1 in which at least some of said vanes extend from said inner edge to said outer edge of said bottom plate of said frame.

4. The loudspeaker of claim 1 in which said apertures formed in said bottom plate are spaced from one another and extend from said inner edge of said bottom plate toward said outer edge, at least some of said vanes terminating at said aperture and others of said vanes extending to said inner edge of said bottom plate in between said apertures.

5. The loudspeaker of claim 4 in which said apertures are semicircular in shape.

6. The loudspeaker of claim 1 in which each of said vanes has an inner end which protrudes beyond said inner edge of said bottom plate.

7. The loudspeaker of claim 6 in which said apertures are formed between said protruding inner ends of adjacent vanes.

8. The loudspeaker of claim 1 in which said inner edge of said bottom plate is formed with a collar extending in a direction toward said upper end of said frame, each of said vanes including an inner end extending between said collar and a location proximate said inner edge of said bottom plate.

9. The loudspeaker of claim 8 in which said apertures are formed by the space between said inner end of adjacent vanes.

10. The loudspeaker of claim 9 further including a number of extensions each protruding outwardly from said collar and being located in said apertures formed by said inner ends of adjacent vanes.

11. The loudspeaker of claim 1 in which said vanes are integrally formed in said bottom plate of said frame, said frame being connected to said top plate of said motor with fasteners extending from at least some of said vanes in said bottom plate into said top plate.

12. A loudspeaker, comprising:

a motor including a top plate having an upper surface, and a movable voice coil;

a frame including an upper end, and a lower end formed with a bottom plate having an inner edge and an outer edge spaced from said inner edge;

a surround connected to said upper end of said frame, and a diaphragm connected between said surround and said voice coil;

a lower suspension connected at one end to said voice coil, and at the other end to said frame at a location between said upper and lower ends of said frame, a cavity being formed in the area between said lower suspension and said lower end of said frame;

cooling structure including a ring located at said inner edge of said bottom plate of said frame and a number of spaced vanes extending from said ring toward said outer edge of said bottom plate, said ring and said vanes being located between said bottom plate of said frame and said top plate of said motor within which passages are formed in the spaces between adjacent vanes, said bottom plate being formed with a number of apertures which connect at least some of said passages with said cavity, said passages and said apertures being positioned to direct a flow of air in and out of said cavity, in response to movement of said voice coil, along a flow path formed between said bottom plate of said frame and said upper surface of said top plate of said motor, said flow of-air being directed along said flow path in thermal communication with at least said top plate.

13. The loudspeaker of claim 12 in which each of said vanes is connected to said bottom plate of said frame.

14. The loudspeaker of claim 12 in which at least some of said vanes extend from said ring part way along said bottom plate toward its outer edge.

15. The loudspeaker of claim 12 in which a separate aperture is formed in said bottom plate in alignment with each of said passages between adjacent vanes.

16. The loudspeaker claim 12 in which at least some of said vanes extend from said ring to said outer edge of said bottom plate.

17. The loudspeaker of claim 12 in which said apertures are slots which extend in a direction from said ring toward said outer edge of said bottom plate in alignment with said passages between adjacent vanes.

18. The loudspeaker of claim 12 in which each of said vanes extends from said ring part way along said bottom plate toward said outer edge thereof, and at least some vanes are formed to receive a fastener which extends into said top plate for mounting said frame thereto.

19. The loudspeaker of claim 12 in which said bottom plate is generally circular in shape, said apertures being formed as slots in said bottom plate which are spaced from one another in a circumferential direction in alignment with said passages between adjacent vanes.

20. The loudspeaker of claim 12 in which said vanes are integrally formed in said bottom plate of said frame, said frame being connected to said top plate of said motor with fasteners extending from at least some of said vanes in said bottom plate into said top plate.

21. The loudspeaker of claim 12 in which said flow of air is directed by said apertures in thermal communication with said ring in the course of movement in and out of said cavity to effect a transfer of heat from said ring.

22. The loudspeaker of claim 12 in which said ring is located in heat transfer communication with said voice coil, the heat conducted from said voice coil by said ring being transferred to said flow of air in and out of said cavity via said passages.

23. The loudspeaker of claim 12 in which said ring is formed with a tapered edge portion which is positioned to contact the flow of air through said passages, said tapered edge portion of said ring being effective to direct at least a portion of the air flow into contact with said voice coil during at least part of the movement thereof.

24. A loudspeaker, comprising:

a motor including a top plate having an user surface, and a movable voice coil;

a frame including an upper end, and a lower end firmed with a bottom plate having an inner edge and an outer edge spaced from said inner edge;

a surround connected to said upper end of said frame, diaphragm connected between said surround and said voice coil;

a lower suspension connected at one end to said voice coil, and at the other end to said frame at a location between said upper and lower ends of said frame, a cavity being formed in the area between said lower suspension and said bottom plate of said frame;

cooling structure including a number of spaced vanes located between said bottom plate of said frame and said upper surface of said top plate of said motor within which passages are formed in the spaces between adjacent vanes, said bottom plate being formed with a number of apertures which are spaced from said inner edge thereof and connect at least some of said passages with said cavity, said passages and said apertures being positioned to direct a flow of air in and out of said cavity, in response to movement of said voice coil, along a flow path formed between said bottom plate of said frame and said upper surface of said top plate of said motor said flow of air being directed along said flow path in thermal communication with said top plate and voice coil of said motor and with at least a portion of said bottom plate of said frame.

25. The loudspeaker of claim 24 in which each of said vanes is connected to said bottom plate of said frame.

26. The loudspeaker of claim 24 in which said one end of at least some of said vanes extends to said outer edge of said bottom plate.

27. The loudspeaker of claim 24 in which said apertures are slots each of which is positioned in alignment with a space between adjacent vanes.

28. The loudspeaker of claim 27 in which each of said slots extends in a direction from said inner edge toward said outer edge of said bottom plate.

29. The loudspeaker of claim 24 in which said inner edge of said bottom plate is located with respect to said voice coil so that a portion of the air flow within said passages is transmitted directly against said voice coil into and out of said cavity, and another portion of the air flow is transmitted through said apertures into and out of said cavity.

30. A loudspeaker comprising:

a motor including top plate having an upper surface, and a movable voice coil;

a frame including an upper end, and a lower end formed with a bottom plate;

a surround connected to said upper end of said frame, and a diagram connected between said surround and said voice coil;

a lower suspension connected at one end to said voice oil, and at the other end to said frame at a location between said upper and lower ends of said frame, a cavity being formed in the area between said lower suspension and said bottom plate of said frame;

an attachment connected between said bottom plate of said frame and said top plate of said motor, said attachment being formed with an inner edge, an outer edge and a number of spaced vanes which rest atop said upper surface of said top plate, adjacent vanes forming passages therebetween which am connected to said cavity by a number of apertures formed in said attachment, said passages and said apertures being positioned to direct a flow of air in and out of said cavity, in response to movement of said voice coil, along a flow path formed between said bottom plate of said frame and said upper surface of said top plate of said motor, said flow of air being directed along said flow path in thermal communication with at least said top plate.

31. The loudspeaker of claim 30 in which at least some of said vanes extend from said inner edge to said outer edge of said attachment.

32. The loudspeaker of claim 30 in which said apertures formed in said attachment are spaced from one another and extend from said inner edge of said attachment toward said outer edge, at least some of said vanes terminating at said apertures and others of said vanes extending to said inner edge of said attachment in between said apertures.

33. The loudspeaker of claim 32 in which said apertures are semicircular in shape.

34. The loudspeaker of claim 30 further including a ring connected to said inner edge of said attachment.

35. The loudspeaker of claim 34 in which at least some of said vanes extend from said ring part way along said attachment toward its outer edge.

36. The loudspeaker of claim 34 in which a separate aperture is formed in said attachment in alignment with each of said passages between adjacent vanes.

37. The loudspeaker of claim 34 in which at least some of said vanes extend from said ring to said outer edge of said bottom plate.

38. The loudspeaker of claim 34 in which said apertures are slots which extend in a direction from said ring toward said outer edge of attachment in alignment with said passages between adjacent vanes.

39. The loudspeaker of claim 34 in which each of said vanes extends from said ring part way along said bottom plate toward said outer edge thereof, said bottom plate of said frame being generally circular in shape including an inner diameter and an outer diameter, said bottom plate being positioned with respect to said attachment so that said inner diameter of said bottom plate abuts said ring of said attachment, said ring being formed with a number of slots which extend in a circumferential direction in alignment with said passages between adjacent vanes.

40. The loudspeaker of claim 34 in which said ring is formed with a tapered edge portion which is positioned to contact the flow of air through said passages, said tapered edge portion of said ring being effective to direct at least a portion of the air flow into contact with said voice coil during at least part of the movement thereof.

41. The loudspeaker of claim 34 in which said flow of air is directed by said apertures in thermal communication with said ring in the course of movement in and out of said cavity to effect a transfer of heat from said ring.

42. The loudspeaker of claim 34 in which said ring is located in heat transfer communication with said voice coil, the heat conducted from said voice coil by said ring being transferred to said flow of air in and out of said cavity via said passages.

43. The loudspeaker of claim 30 in which said inner edge of said attachment is located with respect to said voice coil so that a portion of the air flow within said passages is transmitted directly against said voice coil into and out of said cavity, and another portion of the air flow is transmitted through said apertures into and out of said cavity.

44. A loudspeaker comprising:

a motor including a top plate having an upper surface, and a movable voice coil;

a frame including an upper end, and a lower end formed with a bottom plate having an inner diameter;

a surround connected to said upper end of said frame;

a lower suspension connected at one end to said voice coil, and at the other end to said frame at a location between said upper and lower ends of said frame, a cavity being formed in the area between said lower suspension and said bottom plate of said frame;

an attachment connected between said bottom plate of said frame and said top plate of said motor, said attachment being firmed with an inner ring and a number of spaced vanes which rest atop said upper surface of said top plate, adjacent vanes forming passages therebetween which are connected to said cavity by a number of apertures formed by a space extending between said inner diameter of said bottom plate and said inner ring of said attachment, said passages and said apertures being positioned to direct a flow of air in and out of said cavity, in response to movement of said voice coil, along a flow path formed between said bottom plate of said frame and said upper surface of said top plate of said motor, said flow of air being directed along said flow path in thermal communication with at least said top plate.

45. The loudspeaker of claim 44 in which said inner ring is concentrically disposed about said voice coil, said vanes being circumferentially spaced from one another extending radially outwardly from said inner ring.

46. The loudspeaker of claim 45 in which said inner diameter of said bottom plate is radially spaced from said inner ring of said attachment and rests atop said spaced vanes said apertures being formed in between said inner diameter of said bottom plate and said inner ring of said attachment along said spaces between adjacent vanes.

* * * * *

Disclaimer 6,229,902 — Lucio Proni, Weston, FL. LOUDSPEAKER WITH FRAME COOLING STRUCTURE. Patent dated May 8, 2001. Disclaimer filed May 29, 2001, by assignee, JL Audio, Inc.

Hereby enter the term of this patent shall not extend beyond the expiration date of Pat. No. 6,219,431.

(*Official Gazette, May 14, 2002*)